US012304697B2

(12) United States Patent
Okazawa et al.

(10) Patent No.: US 12,304,697 B2
(45) Date of Patent: May 20, 2025

(54) SPOUT ASSEMBLY, PACKAGING CONTAINER, AND METHOD OF PRODUCING SPOUT ASSEMBLY

(71) Applicant: TOPPAN INC., Tokyo (JP)

(72) Inventors: Hiroshi Okazawa, Tokyo (JP); Yusuke Nakano, Tokyo (JP)

(73) Assignee: TOPPAN INC., Tokyo (JP)

( * ) Notice: Subject to any disclaimer, the term of this patent is extended or adjusted under 35 U.S.C. 154(b) by 33 days.

(21) Appl. No.: 18/212,575

(22) Filed: Jun. 21, 2023

(65) Prior Publication Data

US 2023/0348149 A1 Nov. 2, 2023

Related U.S. Application Data

(63) Continuation of application No. PCT/JP2021/043255, filed on Nov. 25, 2021.

(30) Foreign Application Priority Data

Dec. 22, 2020 (JP) ..... 2020-212698

(51) Int. Cl.
*B65D 41/34* (2006.01)

(52) U.S. Cl.
CPC ..... *B65D 41/3409* (2013.01); *B65D 2401/25* (2020.05)

(58) Field of Classification Search
CPC ..... B65D 41/0414; B65D 41/3409; B65D 2401/25; B65D 41/3428; B65D 5/746
See application file for complete search history.

(56) References Cited

U.S. PATENT DOCUMENTS 9,694,948 B1 * 7/2017 Pakhomov ..... B65D 41/3409
2020/0172298 A1 * 6/2020 Wada ..... B65D 41/023

FOREIGN PATENT DOCUMENTS

JP H02-296666 A 12/1990
JP H03-11649 U 2/1991
JP 2000-344265 A 12/2000
JP 2005-112357 A 4/2005
(Continued)

OTHER PUBLICATIONS

International Searching Authority, "International Search Report," issued in connection with International Patent Application No. PCT/JP2021/043255, dated Feb. 15, 2022.
(Continued)

*Primary Examiner* — Shawn M Braden
(74) *Attorney, Agent, or Firm* — Foley & Lardner LLP

(57) ABSTRACT

A spout assembly a spout, a cap, a band portion, and a rib. The spout has a side wall having a cylindrical shape, an external thread, and a flange. The cap has a top plate, a peripheral wall connected to an outer peripheral edge of the top plate, and an internal thread screwed to the external thread. The band portion is connected to an end of the peripheral wall to fix the cap to the spout at a position between the peripheral wall and the spout. The rib connects the peripheral wall to the band portion and protrudes toward an inside of the cap from the inner peripheral surface at an end portion of the peripheral wall and an inner peripheral surface of the band portion. The spout further has a protrusion provided on the side wall to restrict movement of the cap and the band portion.

11 Claims, 13 Drawing Sheets

(56) References Cited

FOREIGN PATENT DOCUMENTS

| | | | |
|---|---|---|---|
| JP | 2018-150056 | A | 9/2018 |
| JP | 6780793 | B1 | 11/2020 |
| WO | WO-2017/043200 | A1 | 3/2017 |

OTHER PUBLICATIONS

International Searching Authority, "Written Opinion," issued in connection with International Patent Application No. PCT/JP2021/043255, dated Feb. 15, 2022.

* cited by examiner

SPOUT ASSEMBLY, PACKAGING CONTAINER, AND METHOD OF PRODUCING SPOUT ASSEMBLY

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2021/043255, filed on Nov. 25, 2021, which in turn claims the benefit of JP 2020-212698, filed Dec. 22, 2020; the disclosures of all which are incorporated herein by reference in its entirety.

TECHNICAL FIELD

The present disclosure relates to a spout assembly, a packaging container, and a method of producing a spout assembly.

BACKGROUND

Patent Literature 1 discloses a spout assembly provided in a container for storing a liquid or the like. A cap is attached to a spout of the spout assembly, and the cap is rotated to open the spout assembly. In a packaging container in an unopened state, a band portion is connected to such a cap to fix the cap to a spout. Patent Literature 2 discloses a nozzle structure of a bottle having an enhanced tamper evident function. Patent Literature 3 discloses a composite container lid composed of a combination of a lid body, an inner lid made of a thin metal plate, and an upper lid.

CITATION LIST

Patent Literature

[PTL 1] JP 6780793 B; [PTL 2] JP 2005-112357 A; [PTL 3] JP H3-11649 U.

SUMMARY OF THE INVENTION

Technical Problem

The present disclosure provides a spout assembly, a packaging container, and a method of producing a spout assembly that are useful to achieve a band portion having a stable quality.

Solution to Problem

A spout assembly according to an aspect of the present disclosure includes a spout, a cap, a band portion, and a rib. The spout has a side wall that has a cylindrical shape, an external thread that is provided on an outer peripheral surface of the side wall, and a flange that is provided at an end of the side wall. The cap has a top plate, a peripheral wall that is connected to an outer peripheral edge of the top plate, and an internal thread that is provided on an inner peripheral surface of the peripheral wall and screwed to the external thread. The band portion is connected to an end of the peripheral wall to fix the cap to the spout at a position between the peripheral wall and the spout. The rib connects the peripheral wall to the band portion and protrudes toward an inside of the cap from the inner peripheral surface at an end portion of the peripheral wall and an inner peripheral surface of the band portion. The spout further has a protrusion that is provided on the side wall to restrict movement of the cap and the band portion with respect to the spout. The band portion and the peripheral wall are defined by a slit located above a portion of the protrusion that faces the peripheral wall, and the slit extends to an inside of the rib.

In the spout assembly, the slit provided in the boundary between the band portion and the peripheral wall and in the rib is located between the top plate and the portion of the protrusion that faces the peripheral wall. Accordingly, during formation of the slit using the blade of a cutter or the like, the rib abuts the protrusion, thus preventing the peripheral wall and the band portion from being bent inward. This makes it possible to stably form the slit. Therefore, the spout assembly is useful to allow the band portion to have a stable quality.

The rib may have a thickness of 0.4 mm to 0.6 mm. In such a case, it is easy to form a slit in a portion of the rib to obtain a thin portion.

The band portion may be connected to the end of the peripheral wall of the cap so that the band portion and the cap are separated from each other when the cap is removed from the spout. A gap may be provided between a lower end of the band portion and a portion of the flange that faces the lower end of the band portion. The gap may have a width of 0.5 mm or more. In such a case, a gap is formed between the band portion and the cap when the band portion is once separated from the cap and then the cap is reattached to the spout. The gap may also have a width of approximately 0.5 mm or more. This is useful to allow the gap to have high visibility after the cap is opened.

A distance between a lower end of the band portion and the slit may be 6.0 mm or less. In such a case, it is easy to secure the size of the cap or the gap.

The band portion may have a main body that has a cylindrical shape and in which the rib is provided, and a hook portion that is inclined from a lower end portion of the main body toward the top plate. The hook portion may be configured to abut the protrusion to restrict movement of the cap away from the spout. In such a case, it is possible to prevent unintended opening of the cap.

The hook portion may be provided apart from the spout to face a lower surface of the protrusion. Bending processing of the hook portion may generate a restoring force that acts to cause the hook portion to be inclined toward the spout. If the spout is held by the hook portion in contact with the spout due to the restoring force, the band portion may remain at the original position instead of falling downward when the cap is removed. In the above configuration, the hook portion is provided apart from the spout to face the lower surface of the protrusion; thus, the hook portion is less likely to be brought into contact with the spout when the cap is removed. Thus, in the above configuration, the band portion detached from the cap can smoothly fall. Therefore, the above configuration is useful to allow the band portion to have a stable quality.

The plurality of hook portions may be arranged at intervals in a circumferential direction around a center axis of the cap. The band portion may have a plurality of thin portions each of which connects adjacent ones of the plurality of hook portions and that have a smaller thickness than the plurality of hook portions. Even if a restoring force acts to cause one of the hook portions to be inclined toward the center axis, the plurality of thin portions coupling the hook portions restrict inclination movement. This makes it possible to reduce the probability that the hook portions are inclined toward the center axis and brought into contact with the spout. Therefore, the above configuration is useful to allow the band portion to have a stable quality.

A packaging container according to an aspect of the present disclosure includes the spout assembly, and a container body to which the spout assembly is attached. The packaging container includes the spout assembly, and is thus useful to allow the band portion to have a stable quality.

A method of producing a spout assembly according to an aspect of the present disclosure includes preparing a spout having a side wall that has a cylindrical shape and on which an external thread is provided, a flange that is provided at an end of the side wall, and a protrusion that protrudes outward from the side wall, preparing a cap member having a top plate, a peripheral wall that is connected to an outer peripheral edge of the top plate and has an inner peripheral surface on which an internal thread is provided, and a rib that protrudes from an inner peripheral surface of the peripheral wall, screwing the internal thread to the external thread to attach the cap member to the spout, and forming a slit at a position above a portion of the protrusion that faces the peripheral wall while the cap member is attached to the spout, the slit extending from an outer edge of the peripheral wall to an inside of the rib.

In the production method, during formation of the slit, for example, using the blade of a cutter or the like, the rib abuts the protrusion, thus preventing the peripheral wall of the cap member from being bent inward. This makes it possible to stably form the slit. Therefore, the production method is useful to allow the band portion of the spout assembly to have a stable quality.

Advantageous Effects of the Invention

The present disclosure provides a spout assembly, a packaging container, and a method of producing a spout assembly that are useful to achieve a band portion having a stable quality.

BRIEF DESCRIPTION OF THE DRAWINGS

FIG. 11 (*b*) is a schematic diagram illustrating the shape of a thin portion.

DETAILED DESCRIPTION

Description of the Embodiments

Figure 1:
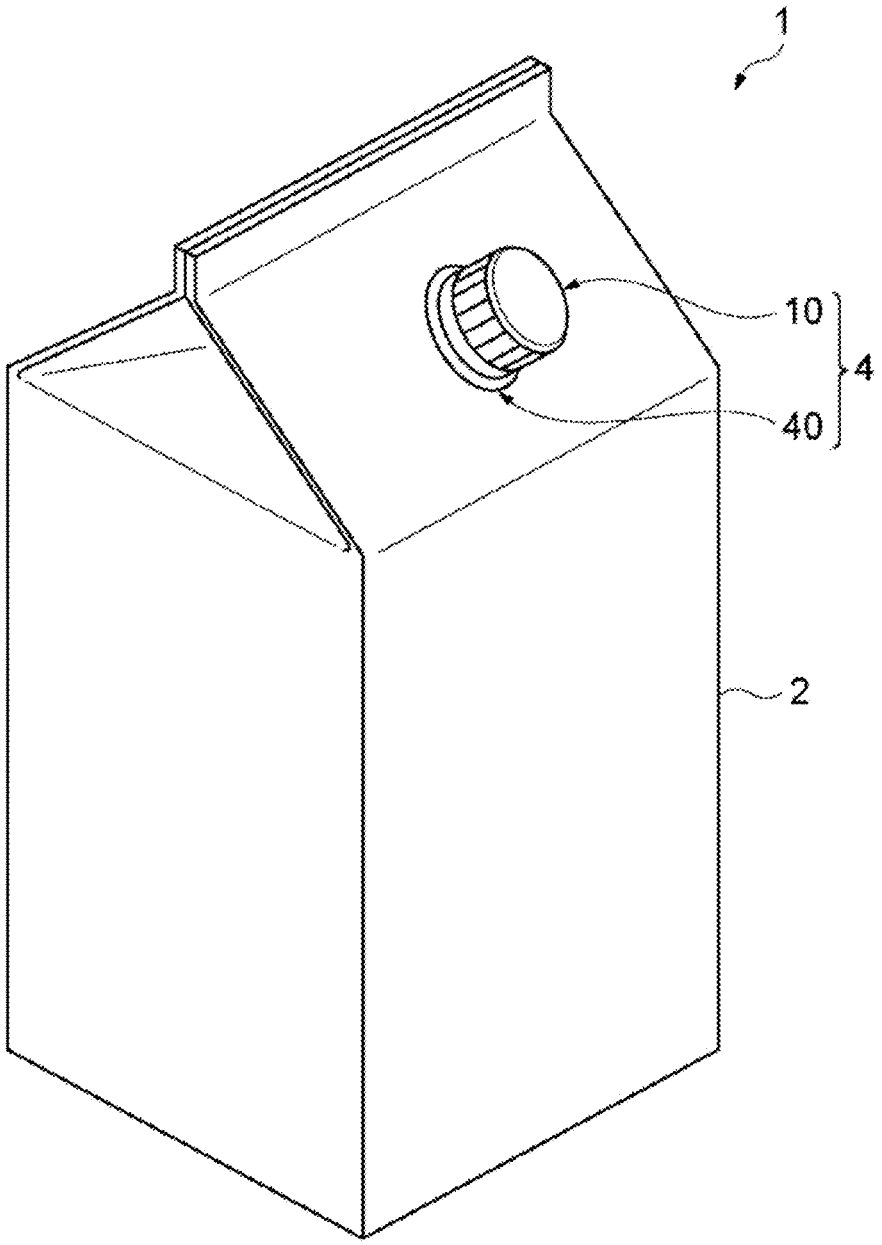
FIG. 1 is a perspective view showing an example of a packaging container including a spout assembly.

Embodiments will be described with reference to the drawings. However, the following embodiments are examples for describing the present disclosure, and are not intended to limit the present disclosure to the following contents. In the description, the same elements or elements having the same function are denoted by the same reference numerals, and redundant description are omitted as appropriate. The positional relationship such as up-down or left-right is based on the positional relationship shown in the drawings unless otherwise specified. Furthermore, the dimensional ratios of the elements are not limited to the ratios shown in the drawings. Some of the drawings show an orthogonal coordinate system defined by the X-axis, Y-axis, and Z-axis.

[Packaging Container]

FIG. 1 shows a perspective view of a packaging container according to an embodiment. A packaging container 1 is a container for storing contents. The contents stored in the packaging container 1 may be liquid, and specific examples of the liquid contents include alcoholic beverages, beverages, and seasonings. The packaging container 1 includes a container body 2 and a spout assembly 4. The container body 2 is a body portion for storing contents such as a liquid. Examples of the material of the container body 2 include paper, resin, and glass. The material of the container body 2 may be a laminate of a sheet of paper and a resin. The spout assembly 4 is attached to the container body 2.

(Spout Assembly)

Figure 2:
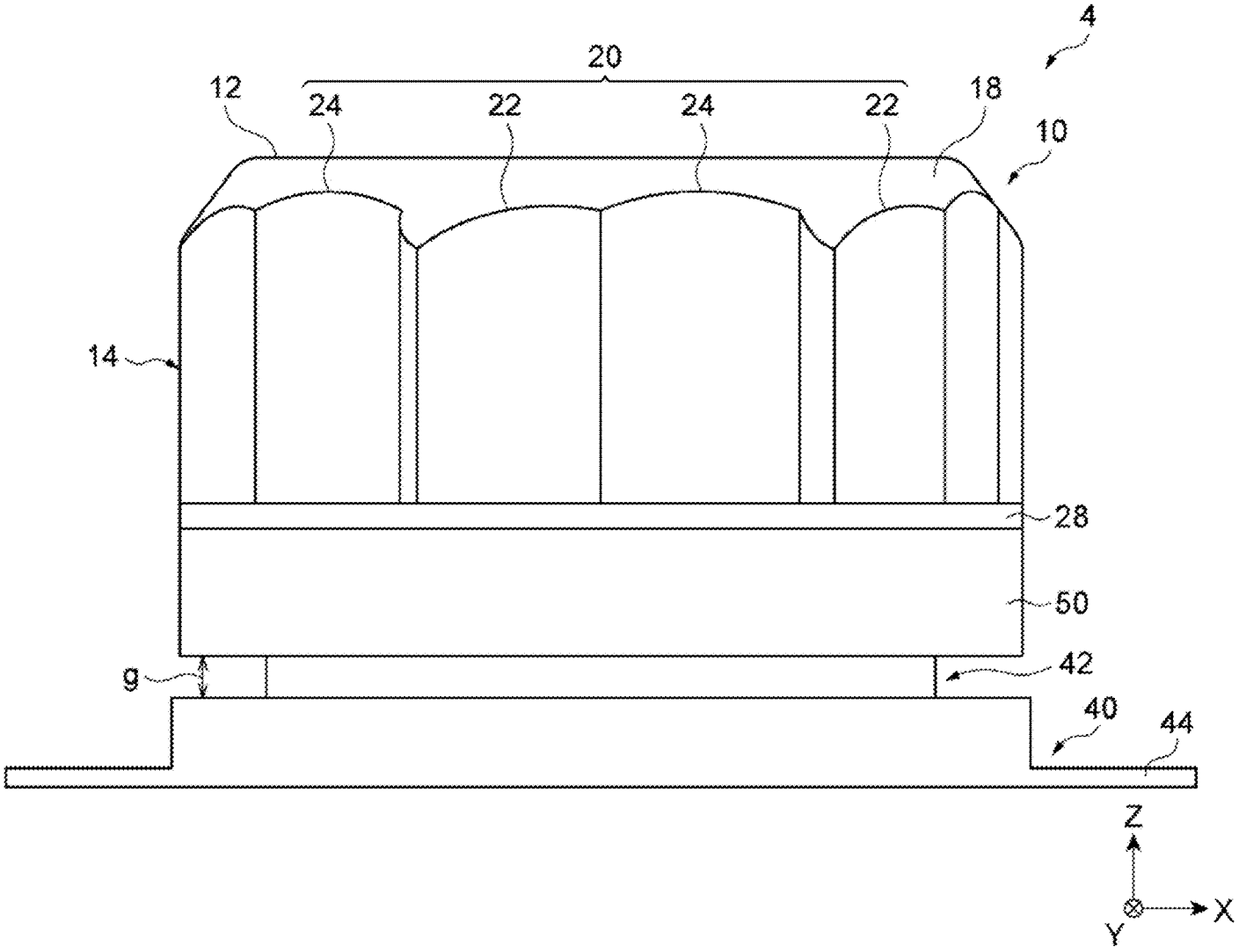
FIG. 2 is a side view showing an example of the spout assembly in a sealed state.
Figure 3:
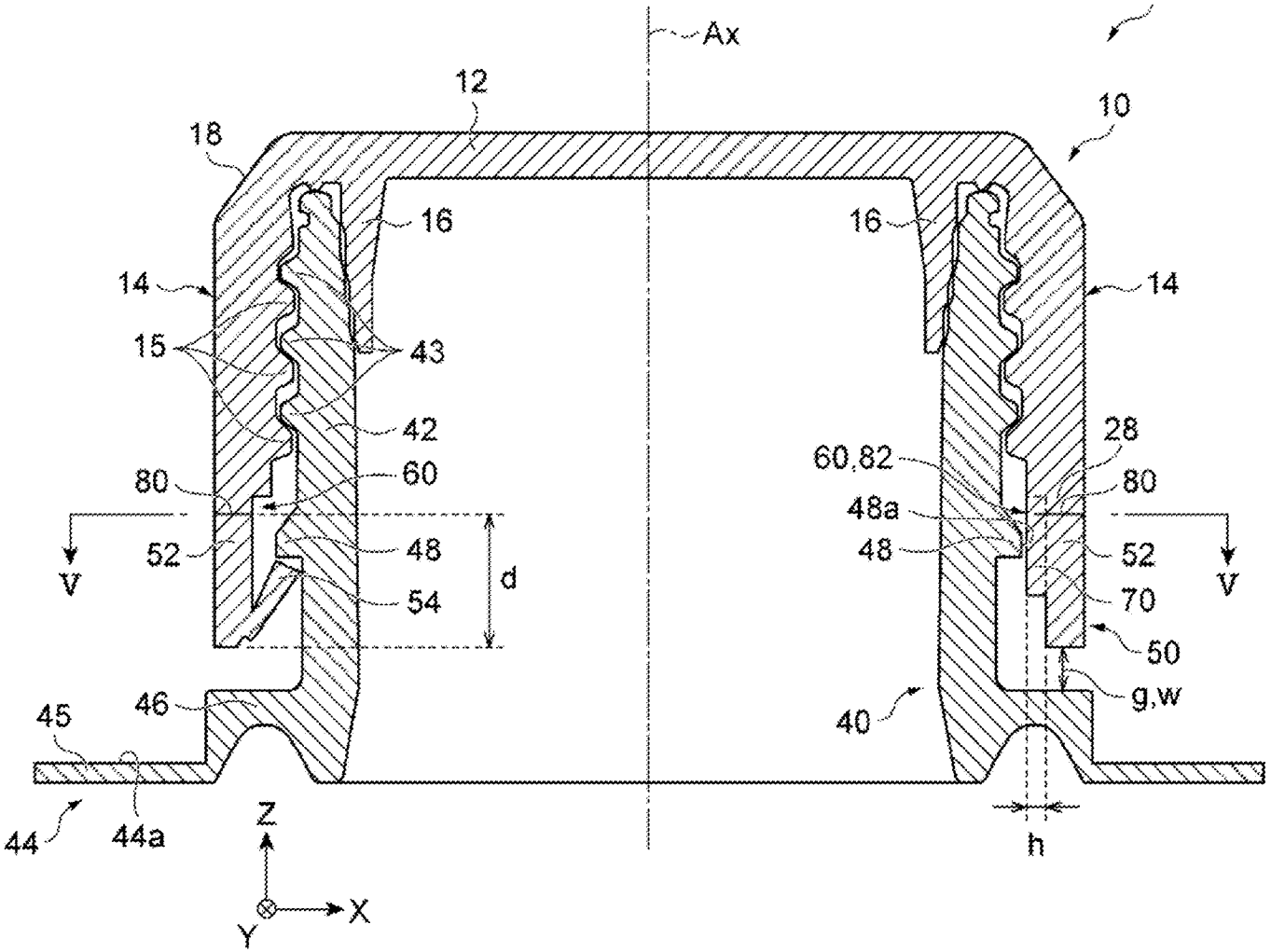
FIG. 3 is a cross-sectional view showing an example of the spout assembly.

The spout assembly 4 is a member constituting a spout opening for pouring out the contents from the packaging container 1 (container body 2). FIG. 2 shows a side view of the spout assembly 4, and FIG. 3 shows a longitudinal cross section of the spout assembly 4 shown in FIG. 2. As shown in FIGS. 2 and 3, the spout assembly 4 includes a cap 10, a spout 40, and a band portion 50. The cap 10 is fixed (attached) to the spout 40.

The cap 10, the spout 40, and the band portion 50 may each be made of a resin. The cap 10 and the band portion 50 may be made of, for example, a polypropylene resin. The spout 40 may be made of a low-density polyethylene resin, in particular, a linear low-density polyethylene resin. Each of the cap 10, the spout 40, and the band portion 50 will be described. In the following description, the terms "inward" and "outward" are used to refer to directions with respect to a center axis Ax (see FIG. 3) of the spout assembly 4. The term "inward" refers to the direction toward the center axis Ax, and the term "outward" refers to the direction away from the center axis Ax. The center axis Ax of the spout assembly 4 coincides with the center axis Ax of the cap 10. The term "vertical direction" refers to the direction parallel to the center axis Ax. The term "upward" refers to the direction in which the cap 10 is moved away from the spout 40, and the term "downward" refers to the direction in which the cap 10 is moved toward the spout 40.

The cap 10 has a top plate 12, a peripheral wall 14, an internal thread 15, and an inner ring 16. The top plate 12 has a disk shape. The outer peripheral edge of the top plate 12 has a tapered portion 18. The peripheral wall 14 extends downward from the tapered portion 18, and has a cylindrical shape. Thus, the upper end of the peripheral wall 14 is connected to the outer peripheral edge of the top plate 12. The center axis Ax of the spout assembly 4 (the center axis Ax of the cap 10) may pass through the center of the top plate 12 and be perpendicular to the upper surface of the top plate 12. The outer peripheral surface of the peripheral wall 14 has a knurled portion 20.

The knurled portion 20 is composed of, for example, a plurality of projecting portions 22 and a plurality of base portions 24 as shown in FIG. 2. The plurality of projecting portions 22 and the plurality of base portions 24 are alternately arranged in the circumferential direction around the center axis Ax of the cap 10. That is, in the circumferential direction, each of the projecting portions 22 is located between two of the base portions 24, and each of the base portions 24 is located between two of the projecting portions 22. The details of the projecting portions 22 and the base portions 24 will be described later.

The peripheral wall 14 may have a base 28 that is provided under the knurled portion 20. The base 28 has a cylindrical shape. The lower end of the base 28 is connected to a band portion 50. The base 28 can facilitate molding of the cap 10 and connection of the cap 10 to the band portion 50. In the present disclosure, the case where a first member is connected (attached) to a second member includes not only the case where the first member is directly connected to the second member but also the case where the first member is connected (attached) to the second member via a fixing member. The knurled portion 20 is provided between the lower end of the tapered portion 18 and the upper end of the base 28. The cap 10 may not necessarily have the tapered portion 18 and the base 28, and for example, the knurled portion 20 may be provided on the entire peripheral wall 14 of the cap 10.

As shown in FIG. 3, the internal thread 15 is provided on the inner peripheral surface of the peripheral wall 14. The inner ring 16 is provided on the inner surface (lower surface) of the top plate 12. The inner ring 16 extends from the inner surface of the top plate 12 along the peripheral wall 14, and has a cylindrical shape. The inner ring 16 is provided on the inner side of the peripheral wall 14 with a gap from the peripheral wall 14.

The spout 40 has a side wall 42, an external thread 43, and a flange 44. The side wall 42 has a cylindrical shape. The side wall 42 has a smaller diameter than the peripheral wall of the cap 10. That is, the distance between the side wall 42 and the center axis Ax is smaller than the distance between the peripheral wall 14 and the center axis Ax. The external thread 43 is provided on the outer peripheral surface of the side wall 42 (the upper half of the outer peripheral surface of the side wall 42). The internal thread 15 on the peripheral wall 14 of the cap 10 is screwed to the external thread 43. An upper end portion (the upper end and a portion close to the upper end) of the side wall 42 is inserted between the peripheral wall 14 and the inner ring 16 of the cap 10. A plurality of portions of the side wall 42 are closely in contact with the peripheral wall 14 or the inner ring 16. This prevents leakage of the contents (e.g., liquid leakage) from a portion of the spout assembly 4 between the spout 40 and the cap 10.

The flange 44 is provided at an end of the side wall 42. The flange 44 is connected to a lower end portion of the side wall 42, and extends outward from the side wall 42. The flange has a cylindrical shape (has an annular shape). The flange 44 is a portion of the spout assembly at which the spout assembly 4 is attached to the container body 2. The packaging material of the container body 2 may be joined to a surface 44*a* of the flange 44. The packaging material may be joined to the flange 44, for example, by ultrasonic welding or adhesion.

The flange 44 includes a ring portion 46 that connects a portion of the flange 44 that has the surface 44*a* (hereinafter referred to as a "flange portion 45") to the side wall 42. The ring portion 46 is provided on the inner side of the flange portion 45, and is connected to, for example, a portion close to the lower end portion (the side surface of the lower end portion) of the side wall 42.

The band portion 50 is attached to the lower end of the peripheral wall 14 of the cap 10. The band portion 50 is connected to the lower end of the base 28 of the peripheral wall 14. The band portion 50 has a cylindrical shape. The band portion 50 has substantially the same diameter (outer diameter) as the peripheral wall 14 of the cap 10. The band portion 50 has a function of fixing the cap 10 to the spout 40 at a position between the peripheral wall 14 of the cap and the spout 40. The band portion 50 is provided between the peripheral wall 14 and the ring portion 46 of the spout 40 to restrict movement of the cap 10 away from the spout 40.

A gap g is provided between the lower end of the band portion 50 and a portion of the flange 44 that faces the lower end of the band portion 50. In the example shown in FIG. 3, the gap g is provided between the lower end of the band portion 50 and the upper end of the ring portion 46 of the flange 44. The gap g is provided to prevent tampering.

More specifically, the band portion 50 is connected to the peripheral wall 14 so that the band portion 50 and the cap 10 are separated from each other when the cap 10 in an unopened state (a state in which the cap 10 is fixed to the spout 40) is removed from the spout 40. The unopened state (sealed state) of the cap 10 is an initial state of the cap 10 in which the cap 10 has never been removed from the spout 40. When the band portion 50 and the cap 10 are separated (detached) from each other, the band portion 50 and the cap 10 are disconnected from each other. That is, the band portion 50 and the cap 10 are connected to each other so that the band portion 50 is left with the spout 40 when the cap 10 is removed from the spout 40. In this case, when the cap is opened by removing the cap 10 from the spout 40, the band portion 50 is left with the spout 40.

Figure 4:
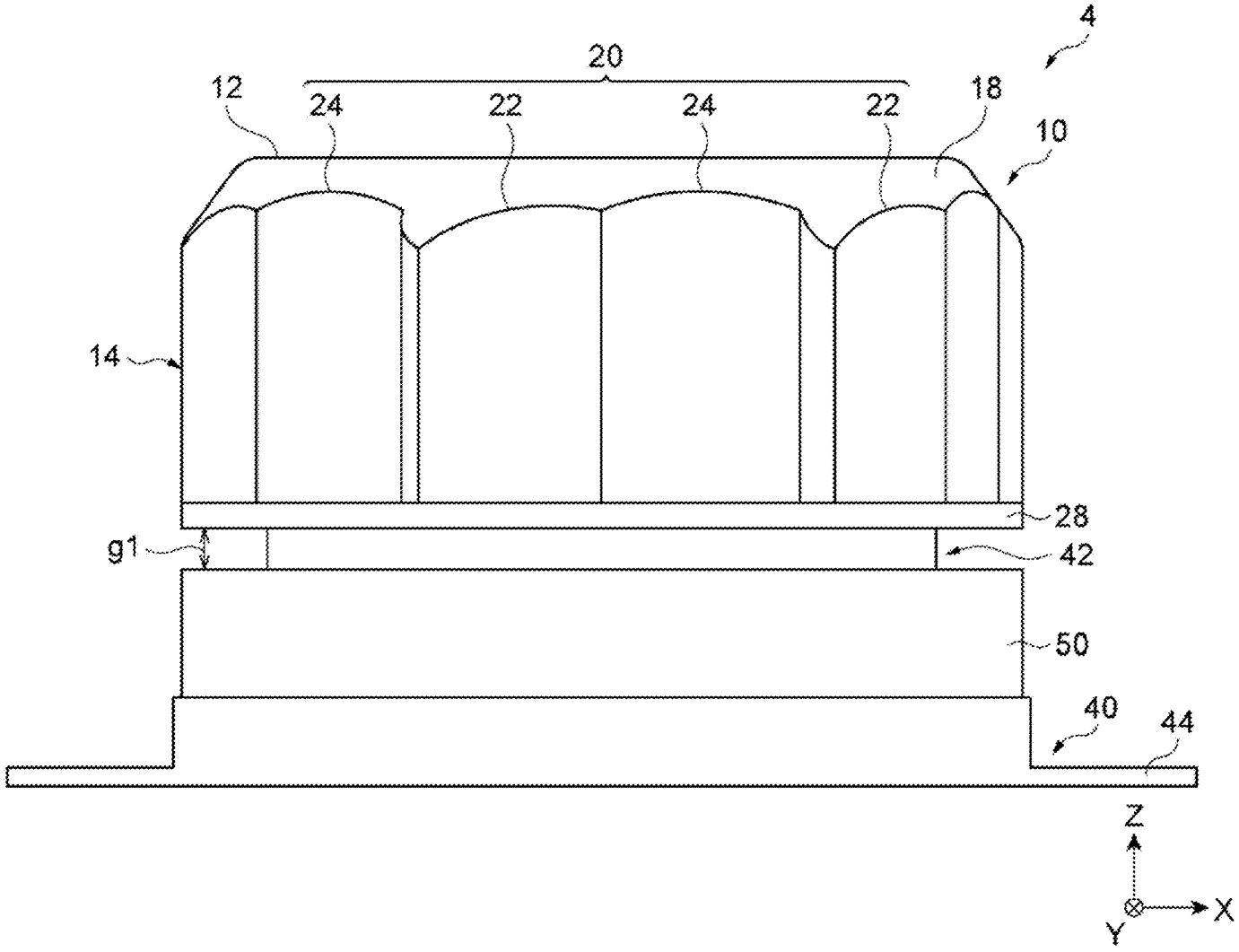
FIG. 4 is a side view showing an example of the spout assembly after the spout assembly is opened.

The band portion 50 detached from the cap 10 can be moved downward so that the lower end of the band portion 50 abuts the ring portion 46 of the flange 44. The gap g is provided so that the band portion 50 falls downward when the band portion 50 is detached from the cap 10. When the cap 10 is once opened and then reattached to the spout 40, a gap g1 is formed between the lower end of the cap 10 and the upper end of the band portion 50 left with the spout 40. FIG. 4 shows a side view of the spout assembly 4 in which the cap 10 once opened is reattached to the spout 40. The width (size) of the gap g1 formed at this time corresponds to (is substantially the same as) the width of the gap g in an unopened state. After the cap 10 is once opened, the gap formed between the lower end of the cap 10 and the upper end of the band portion 50 enables visual confirmation that the cap 10 has already been opened.

A width w of the gap g (width of the gap g1) may be 0.5 mm or more. The width w of the gap g corresponds to the minimum distance between the lower end of the band portion 50 and the upper end of the ring portion 46 of the flange 44. From the viewpoint of visibility (more specifically, the visibility of the gap after the cap is opened), the width w may be 0.7 mm or more, 0.8 mm or more, 0.9 mm or more, or 1.0 mm or more. From the viewpoint of securing the size (length in the direction parallel to the center axis Ax) of the cap, the width w may be 2.0 mm or less, 1.8 mm or less, 1.6 mm or less, or 1.4 mm or less. For example, the width w is 1.0 mm to 1.4 mm, or 1.1 mm to 1.3 mm.

Figure 5:
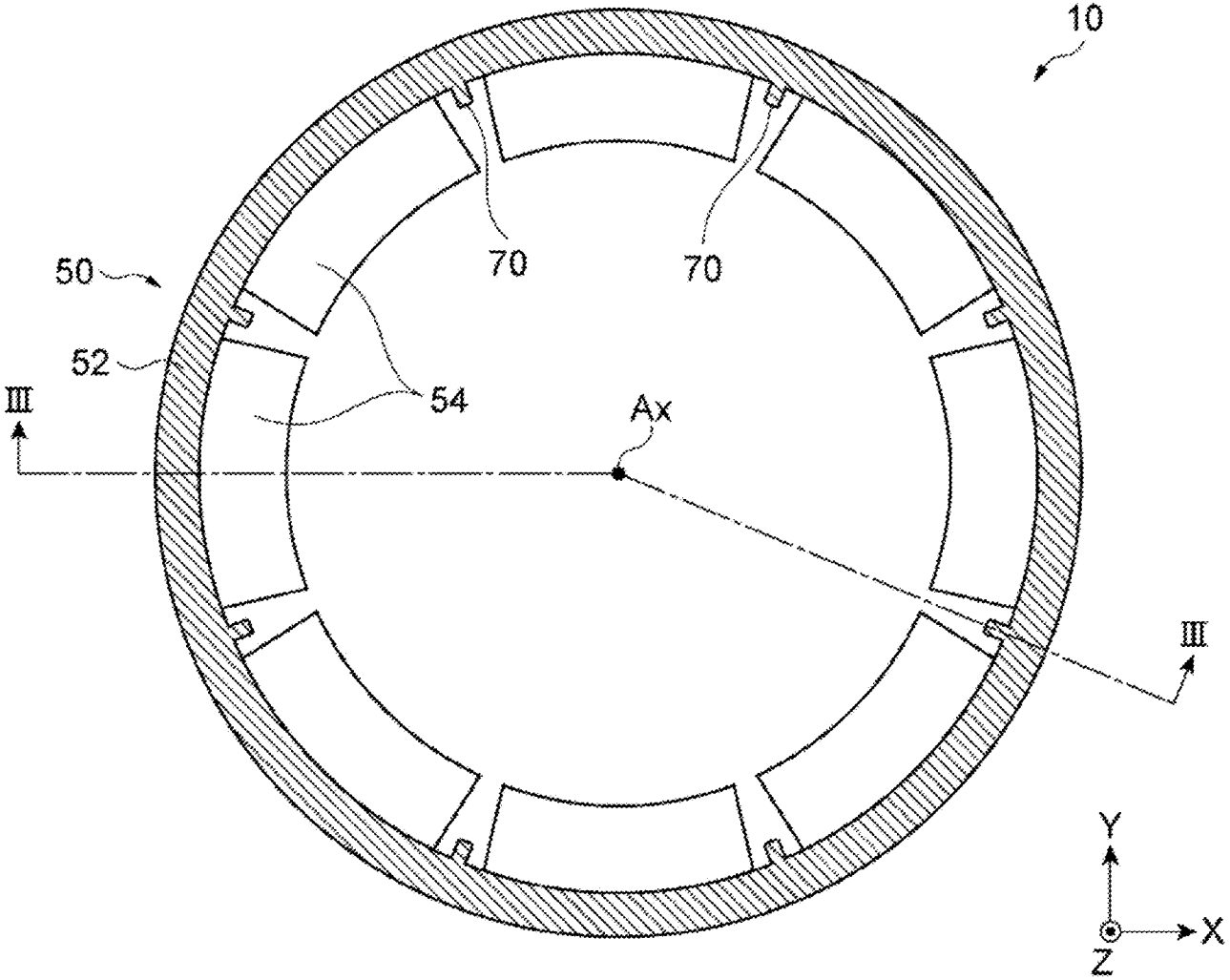
FIG. 5 is a cross-sectional view showing an example of the boundary between a cap and a band portion.
Figure 6:
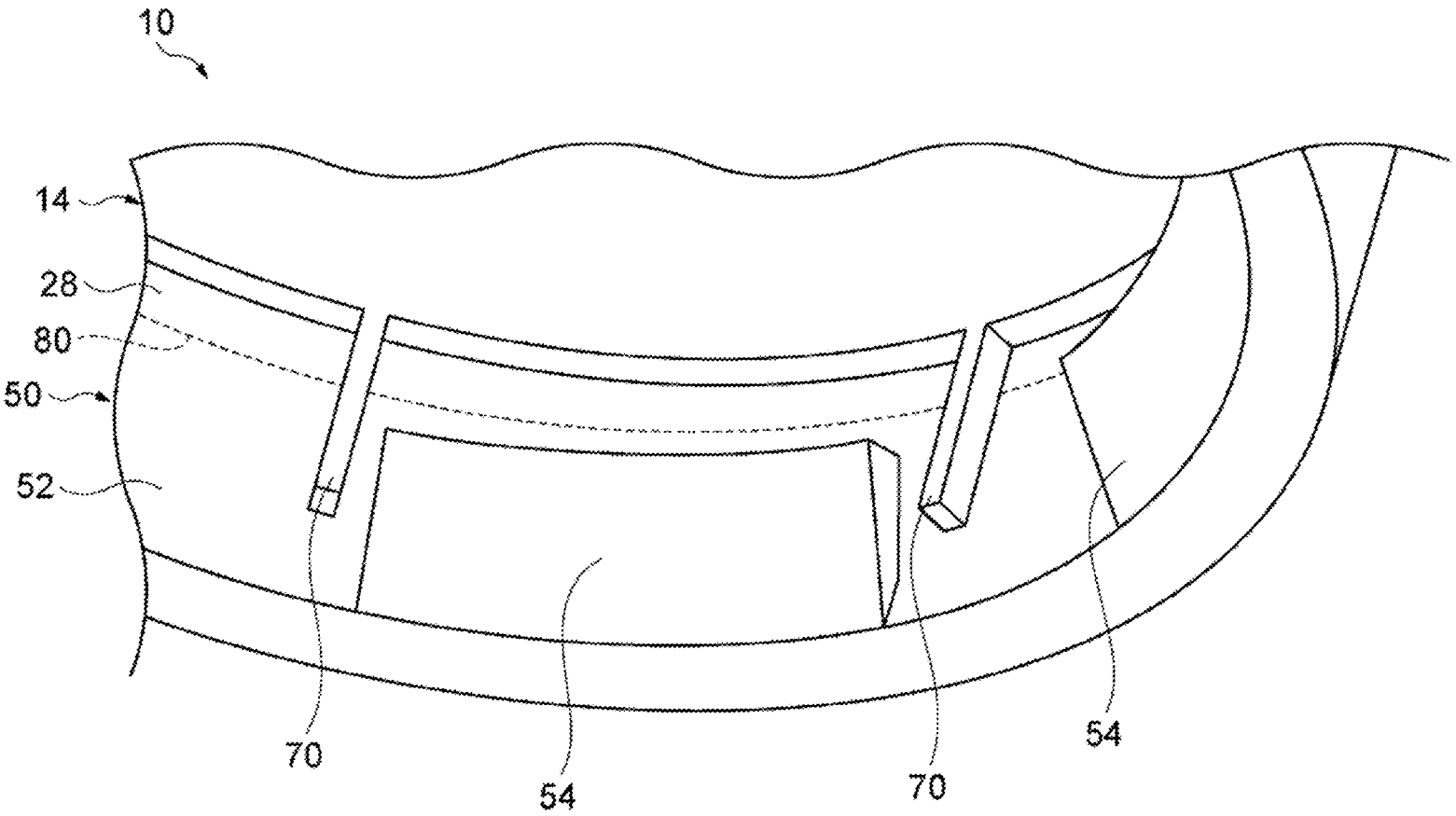
FIG. 6 is a perspective view showing an example of the inside of the cap and the band portion.

FIG. 5 shows a cross section taken along line V-V in FIG. 3. Line V-V corresponds to the boundary between the band portion 50 and the peripheral wall 14 of the cap 10. FIG. 6 schematically shows the inside of the band portion 50 and the cap 10. The band portion 50 has a main body 52 (band body) and a plurality of hook portions 54. The main body 52 is provided under the peripheral wall 14 of the cap 10, and has a cylindrical shape. The main body 52 has substantially the same diameter (outer diameter) as the base 28 of the peripheral wall 14.

The plurality of hook portions 54 are connected to a lower end portion of the main body 52, and are inclined (are inclined and extend) from the lower end portion (lower portion of the inner peripheral surface) toward the top plate 12 of the cap 10. The hook portions 54 are inclined so that the distance between the center axis Ax and the hook portions 54 decreases toward the top plate 12. As shown in FIG. 5, the hook portions 54 are provided at predetermined intervals in the circumferential direction around the center axis Ax. The hook portions 54 have a function of restricting relative movement of the cap 10 away from the spout 40. The hook portions 54 may be referred to as flaps.

The spout assembly 4 has a breaking portion 60. The breaking portion 60 connects the main body 52 to the peripheral wall 14 of the cap 10 so that the band portion 50 and the cap are detached from each other when the cap 10 is removed from the spout 40. The breaking portion 60 has a plurality of ribs 70. The plurality of ribs 70 are provided on the inner peripheral surface of the main body 52 of the band portion 50, and protrude inward (toward the center axis Ax) from the inner peripheral surface (see also FIG. 6). The plurality of ribs 70 are provided at predetermined intervals in the circumferential direction around the center axis Ax. For example, the plurality of ribs 70 and the plurality of hook portions 54 are alternately arranged in the circumferential direction around the center axis Ax. The thickness of the ribs 70 (the amount of protrusion of the ribs 70 from the inner peripheral surface of the main body 52) is smaller than the amount of protrusion of the hook portions 54 from the inner peripheral surface of the main body 52.

More specifically, as shown in FIG. 3, the ribs 70 are provided on the inner peripheral surface of the main body 52 and the inner peripheral surface of the base 28 of the cap (protrude from these inner peripheral surfaces). The left half of the cross-sectional view in FIG. shows a cross section of the spout assembly 4 at the position at which the hook portions 54 are provided, and the right half of the cross-sectional view in FIG. 3 shows a cross section of the spout assembly 4 at the position at which the ribs 70 are provided. A slit 80 that extends to the inside (e.g., the approximate center) of the ribs 70 is provided at the boundary between the lower end of the base 28 of the peripheral wall 14 of the cap 10 and the upper end of the main body 52 of the band portion 50. Thus, the cap 10 and the band portion 50 are defined by the slit 80.

For example, after a portion corresponding to the cap 10, a portion corresponding to the band portion 50, and the ribs 70 are integrally formed, the slit 80 is formed at the height position of the boundary between the base 28 and the band portion 50. The slit 80 extends from the outside of the cap 10 so that the ribs 70 are not separated. The slit 80 is continuously provided in the circumferential direction around the center axis Ax. Thus, the cap 10 and the band portion are defined (separated), and the peripheral wall 14 (base 28) and the band portion 50 are connected to each other via portions of the ribs 70 at which the slit 80 is not provided (hereinafter referred to as "thin portions 82"). That is, the plurality of ribs 70 connect the peripheral wall 14 to the band portion 50. The thin portions 82 are portions of the ribs 70 at which the slit 80 is not provided at the height position of the slit 80.

The spout 40 has a protrusion 48. The protrusion 48 is provided on the side wall of the spout 40, and projects outward from the side wall 42. The protrusion 48 has a cylindrical shape, and is continuously provided in the circumferential direction on the outer peripheral surface of the side wall 42 below the external thread 43. The protrusion 48 has a facing surface 48*a* that faces the inner peripheral surfaces of the base 28 and the main body 52 while the cap 10 is fixed to the spout 40. The facing surface 48*a* extends along the peripheral wall 14 (or the main body 52). A part of the facing surface 48*a* is located close to the ribs 70.

The hook portions 54 are provided so that the tip of the hook portions 54 faces the lower end (lower surface) of the protrusion 48. When the hook portions 54 abut the protrusion 48, movement of the cap 10 away from the spout 40 is restricted. That is, the protrusion 48 restricts movement of the cap 10 and the band portion 50 with respect to the spout 40.

In order to pour out the contents from the packaging container 1 in an unopened state, a user such as a consumer rotates the cap 10 relative to the spout 40 to remove the cap 10 from the spout 40. Due to the relative rotation of the cap 10, the internal thread 15 on the peripheral wall 14 and the external thread 43 on the side wall 42 are gradually disengaged from each other, causing the cap 10 and the band portion 50 to gradually move away from the flange 44 (ring portion 46) of the spout 40.

Shortly after the cap 10 and the band portion 50 start moving away from the flange 44, the hook portions 54 of the band portion 50 abut the protrusion 48. This causes a tensile stress at the portions (thin portions 82) of the spout assembly 4 between the base 28 of the cap 10 and the band portion 50, restricting movement of the cap 10 and the band portion 50 away from the flange 44 of the spout 40. When the relative rotation of the cap 10 is continued and the tensile stress reaches a predetermined value, the thin portions 82 are broken. Breakage of the thin portions causes the restriction of movement of the cap 10 to be removed.

The thin portions 82 of the respective plurality of ribs 70 are formed to be broken when the tensile stress reaches a predetermined value. When all the thin portions 82 are broken, the cap 10 and the band portion 50 are physically separated (detached) from each other. The band portion 50 separated from the cap 10 is moved downward into contact with the ring portion 46 of the spout 40. This allows the band portion 50 to be left with the spout 40 after the cap 10 is removed from the spout 40, thus preventing the scattering of the band portion 50.

The slit 80 is located above the facing surface 48*a* of the protrusion 48 (the upper end of the facing surface 48*a*). The height of the slit 80 from the lower end of the flange 44 is larger than that of the upper end of the facing surface 48*a*. In this case, the distance between the slit 80 and the top plate 12 in the vertical direction is smaller than the distance between the facing surface 48*a* of the protrusion 48 and the top plate 12 in the vertical direction.

A distance d between the lower end of the band portion 50 and the slit 80 (i.e., the upper end of the band portion 50) may be 6.0 mm or less. From the viewpoint of securing the size of the cap 10 or the size of the gap g, the distance d may be 5.5 mm or less, 5.0 mm or less, or 4.5 mm or less. From the viewpoint of more reliable fixing of the cap 10 to the spout 40 or from the viewpoint of the ease of formation of the hook portions 54, the distance d may be 3.0 mm or more, 3.5 mm or more, or 4.0 mm or more. For example, the distance d may be 3.0 mm to 6.0 mm, or 3.5 mm to 5.5 mm. The distance d is defined as the minimum distance between the lower end of the band portion 50 and the slit 80.

The ribs 70 may have a thickness h of 0.4 mm to 0.6 mm. The thickness h corresponds to the minimum distance between the inner peripheral surface on which the ribs 70 are provided and a surface of the ribs 70 that faces the center axis Ax. From the viewpoint of the ease of formation of the slit 80, the thickness h may be 0.42 mm or more, 0.44 mm or more, 0.46 mm or more, or 0.48 mm or more. From the viewpoint of securing the thickness (length in the horizontal direction) of the protrusion 48, the thickness h may be 0.58 mm or less, 0.56 mm or less, 0.54 mm or less, or 0.52 mm or less. For example, the thickness h may be 0.42 mm to 0.58 mm, or 0.44 mm to 0.56 mm.

Figure 7:
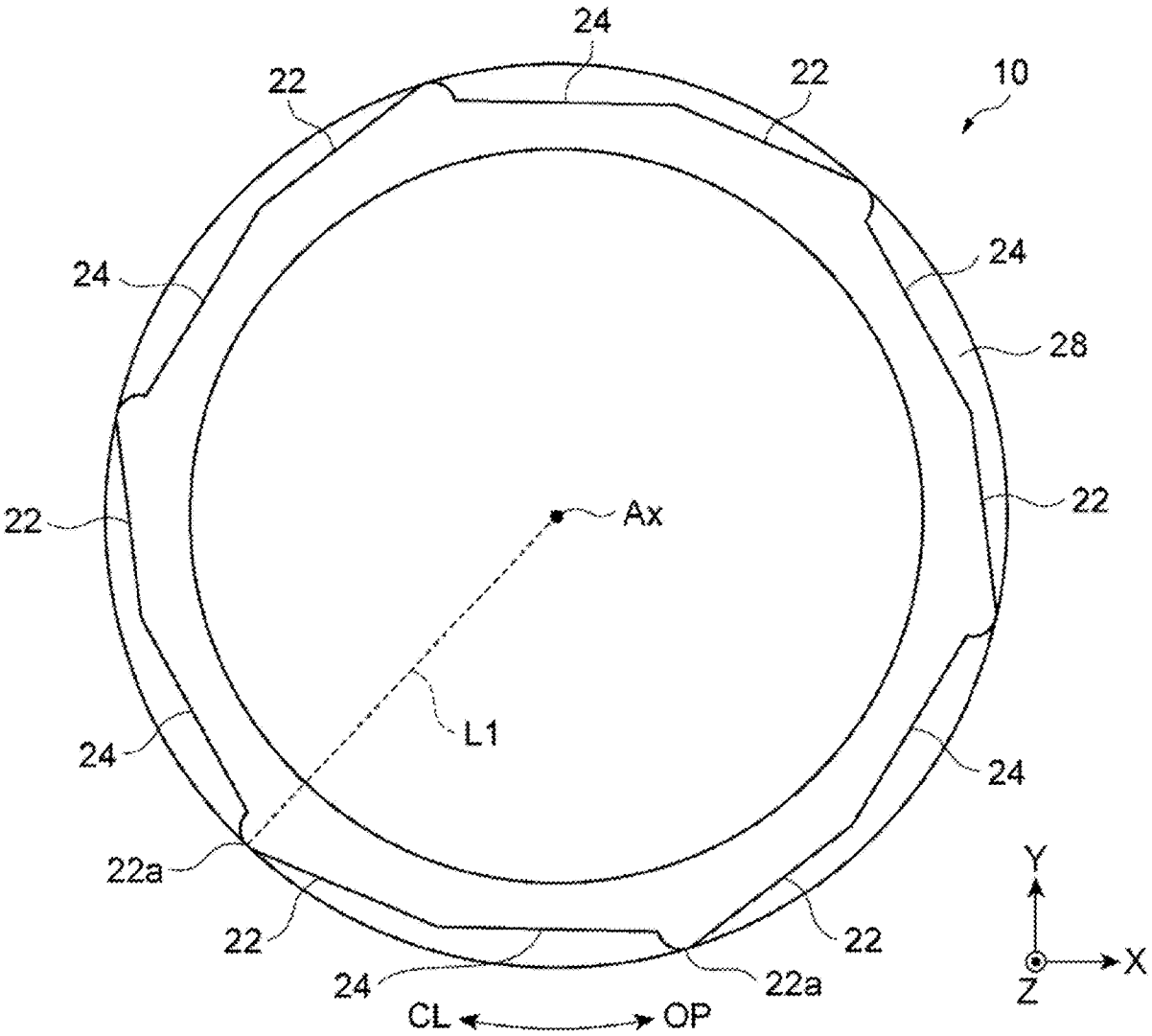
FIG. 7 is a plan view showing an example of the cap.

Next, the details of the projecting portions 22 and the base portions 24 of the knurled portion 20 will be described also with reference to FIG. 7. FIG. 7 shows a plan view of the cap 10. As shown in FIG. 7, the knurled portion 20 may be composed of six projecting portions and six base portions 24. That is, six pairs of projecting portions 22 and base portions 24 may be provided on the outer peripheral surface of the peripheral wall 14.

The ridge line of the projecting portions 22 (the outer edge of the projecting portions 22 in plan view) is serrated. That is, the projecting portions 22 are serrated projections. The ridge line of each of the projecting portions 22 is not symmetric with respect to an imaginary line segment L1 passing through a top 22*a* of the corresponding projecting portion 22 and the center axis Ax. In this case, two ridge lines into which the ridge line of the projecting portion 22 is divided by the line segment L1 have different lengths. Thus, when a consumer holds the cap 10 with their fingers and rotates the cap 10, finger placement and touch vary depending on the direction of rotation.

The internal thread 15 of the cap 10 and the external thread 43 of the spout 40 are configured such that the cap 10 can be removed from the spout 40 when the cap 10 is rotated in the direction of arrow OP shown in FIG. 7 (counterclockwise) while the spout 40 is fixed. On the other hand, when the cap 10 removed is fitted to the spout 40 and rotated in the direction of arrow CL (clockwise) while the spout 40 is fixed, the internal thread 15 is screwed to the external thread to attach the cap 10 to the spout 40.

In the spout assembly 4 in an unopened state, the cap 10 is connected to the band portion 50 via the thin portions 82; thus, a large rotational force is required to rotate the cap 10 with respect to the spout 40 as compared with the case where the cap 10 is rotated with respect to the spout 40 after the cap 10 is once opened. The top 22*a* of each of the projecting portions 22 is located closer to one of the base portions 24 that is adjacent to the corresponding projecting portion on the upstream side than to one of the base portions 24 that is adjacent to the corresponding projecting portion 22 on the downstream side as viewed in the direction of arrow OP as the direction of rotation. In other words, the top 22*a* of each of the projecting portions 22 is located closer to one of the base portions 24 provided on the upstream side of the corresponding projecting portion 22 than to one of the base portions 24 provided on the downstream side of the corresponding projecting portion 22 in the circumferential direction around the center axis Ax.

The projecting portions 22 protrude outward from an imaginary circle passing through the boundaries between the projecting portions 22 and the base portions 24 adjacent to each other (hereinafter referred to as an "imaginary circle"). More specifically, most portion of the projecting portions 22 that includes the top 22*a* is located outside the imaginary circle. The center of the imaginary circle substantially coincides with the center axis Ax, and the imaginary circle passes through all the boundaries between the projecting portions 22 and the base portions (the points at which the ridge line of the projecting portions 22 and the ridge line of the base portions 24 are connected to each other in plan view).

The base portions 24 (the ridge line of the base portions 24) are located inside the imaginary circle. The ridge line of the base portions 24 may be a linear line segment connecting the boundaries adjacent to each other in the circumferential direction around the center axis Ax. Alternatively, unlike in the example shown in FIG. 7, the ridge line of the base portions 24 may be a curved line that connects the boundaries adjacent to each other and protrudes (is concave) inward. When the ridge line of the base portions 24 is a linear line segment, the outer peripheral surface constituted by the base portions 24 is a flat surface. When the ridge line of the base portions 24 is a curved line protruding inward, the outer peripheral surface constituted by the base portions 24 is a curved surface whose center portion is curved toward the center axis Ax.

[Method of Producing Spout Assembly]

Next, an example of a method of producing the spout assembly 4 will be described. The method of producing the spout assembly 4 includes at least the steps of preparing the spout 40, preparing a cap member, screwing the internal thread 15 to the external thread 43 to attach the cap member to the spout 40, and forming the slit 80 while the cap member is attached to the spout.

In the process of producing the spout assembly 4, for example, first, the step of fixing a cap member to the spout 40 is performed. In this step, the spout 40 and a cap member in which a portion corresponding to the cap 10, a portion corresponding to the band portion 50, and the plurality of ribs 70 are integrated are prepared. The cap member has the same shape as the cap 10, the band portion 50, and the ribs 70, except that the cap member does not have the thin portions (does not have the slit 80). Thus, the names of the components of the cap 10 and the band portion 50 are used in the following description. The peripheral wall of the cap member corresponds to the peripheral wall 14 of the cap 10 and the main body 52 of the band portion 50 before the cap 10 and the band portion 50 are separated from each other.

The upper end portion of the side wall 42 of the spout 40 is inserted inside the peripheral wall of the cap member. When the cap member is rotated in the CL direction in FIG. 6 with respect to the spout 40, the internal thread 15 is screwed to the external thread 43, causing the cap member to be moved toward the flange 44 of the spout 40. The plurality of hook portions 54 abut the protrusion 48 (the inclined surface of the protrusion 48 that is located in the upper portion of the protrusion 48), and then start climbing on the protrusion 48. Furthermore, the upper end portion of the side wall 42 of the spout 40 starts being inserted between the peripheral wall and the inner ring 16 of the cap member.

When the cap member is further rotated in the CL direction with respect to the spout 40, the hook portions 54 climb over the protrusion 48, and the upper end portion of the side wall of the spout 40 is inserted between the peripheral wall and the inner ring 16 of the cap member. Thus, the spout 40 is capped with the cap member (the cap member is attached to the spout 40).

Then, the step of forming the slit 80 (thin portions 82) in the cap member is performed. For example, a slit is made throughout the circumference of the peripheral wall 14 of the cap member using a score cutter to form the slit 80. For example, from the outer periphery of the peripheral wall 14, the blade of a score cutter is placed on a portion of the cap member that is to serve as the boundary between the base 28 of the peripheral wall 14 and the band portion 50 and on a portion of the ribs 70 that is to serve as the boundary. In the ribs 70, the blade of the score cutter is inserted into a substantially center portion of the ribs 70.

Then, the cap member and the spout 40 are rotated around the center axis Ax while the score cutter is placed on the inside of the cap member and the ribs to form the slit 80. Thus, the thin portions 82 are formed in the ribs 70. As described above, in the step of forming the thin portions 82, the slit 80 is formed while the cap member and the spout 40 are fixed to each other.

When the thin portions 82 are formed, the cap member is separated into the cap 10 and the band portion 50, and thus the spout assembly 4 is obtained. By adjusting the size of the slit 80, the size and thickness of the thin portions 82 can be varied to adjust the force required to break the thin portions 82. Then, the step of attaching the spout assembly 4 to the container body is performed. Thus, the packaging container 1 is produced.

An embodiment has been described; however, the present disclosure is not limited to the embodiment. In the following, modifications will be described.

First Modification

Figure 8:
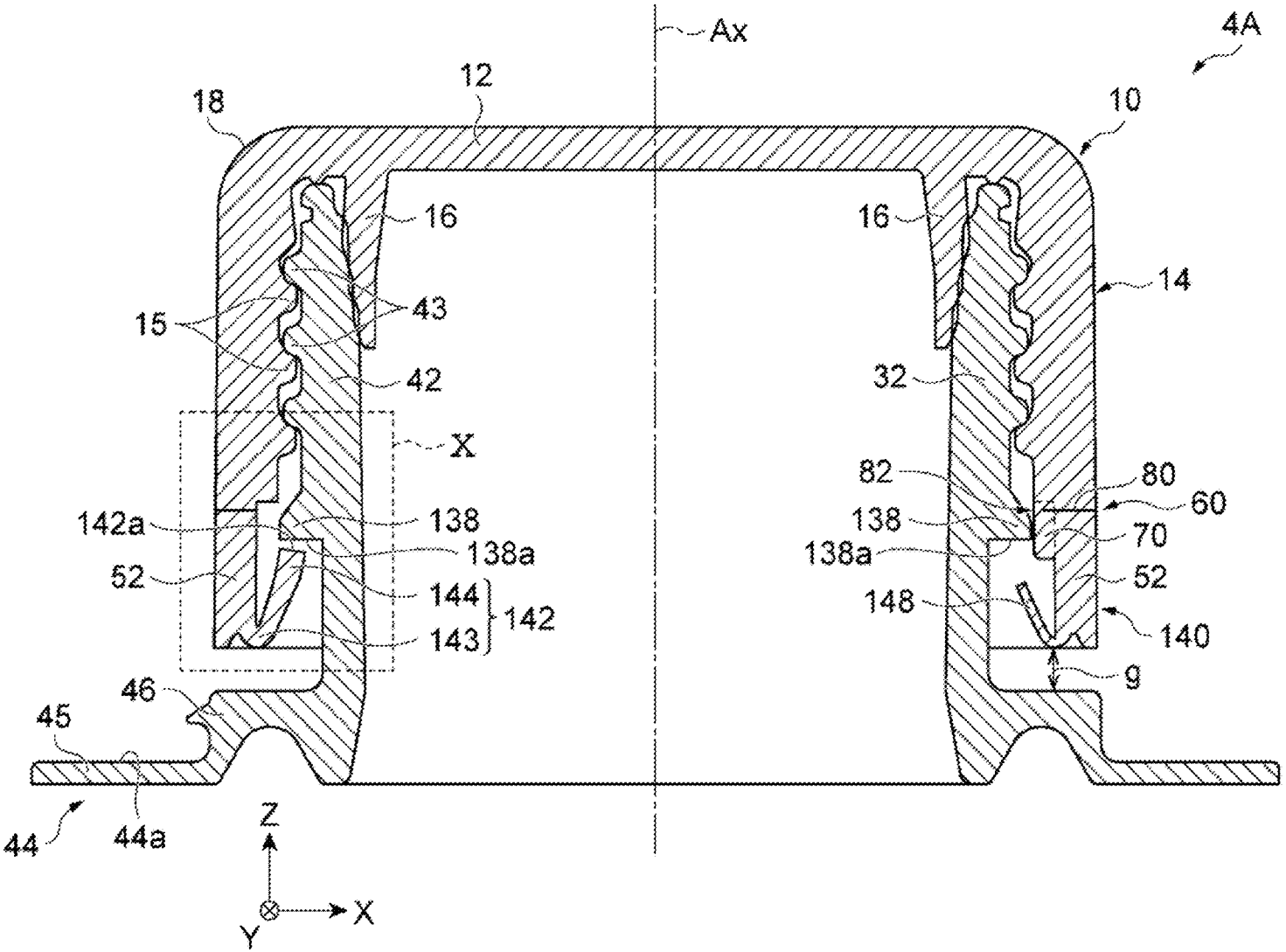
FIG. 8 is a cross-sectional view showing a spout assembly according to a first modification.

FIG. 8 shows a spout assembly 4A according to the first modification. The spout assembly 4A is different from the spout assembly 4 in that the spout assembly 4A has a band portion 140 instead of the band portion 50 and that the spout 40 has a protrusion 138 instead of the protrusion 48.

The protrusion 138 has the same configuration as the protrusion 48. The protrusion is provided on the outer peripheral surface of the side wall 42 to project outward from the side wall 42. The protrusion 138 has an annular shape, and is continuously provided in the circumferential direction around the center axis Ax on the outer peripheral surface of the side wall 42. The protrusion 138 is located below the external thread 43 and provided in a center portion of the side wall 42 in the vertical direction. The protrusion 138 has a function of restricting movement of the band portion 140.

Figure 9:
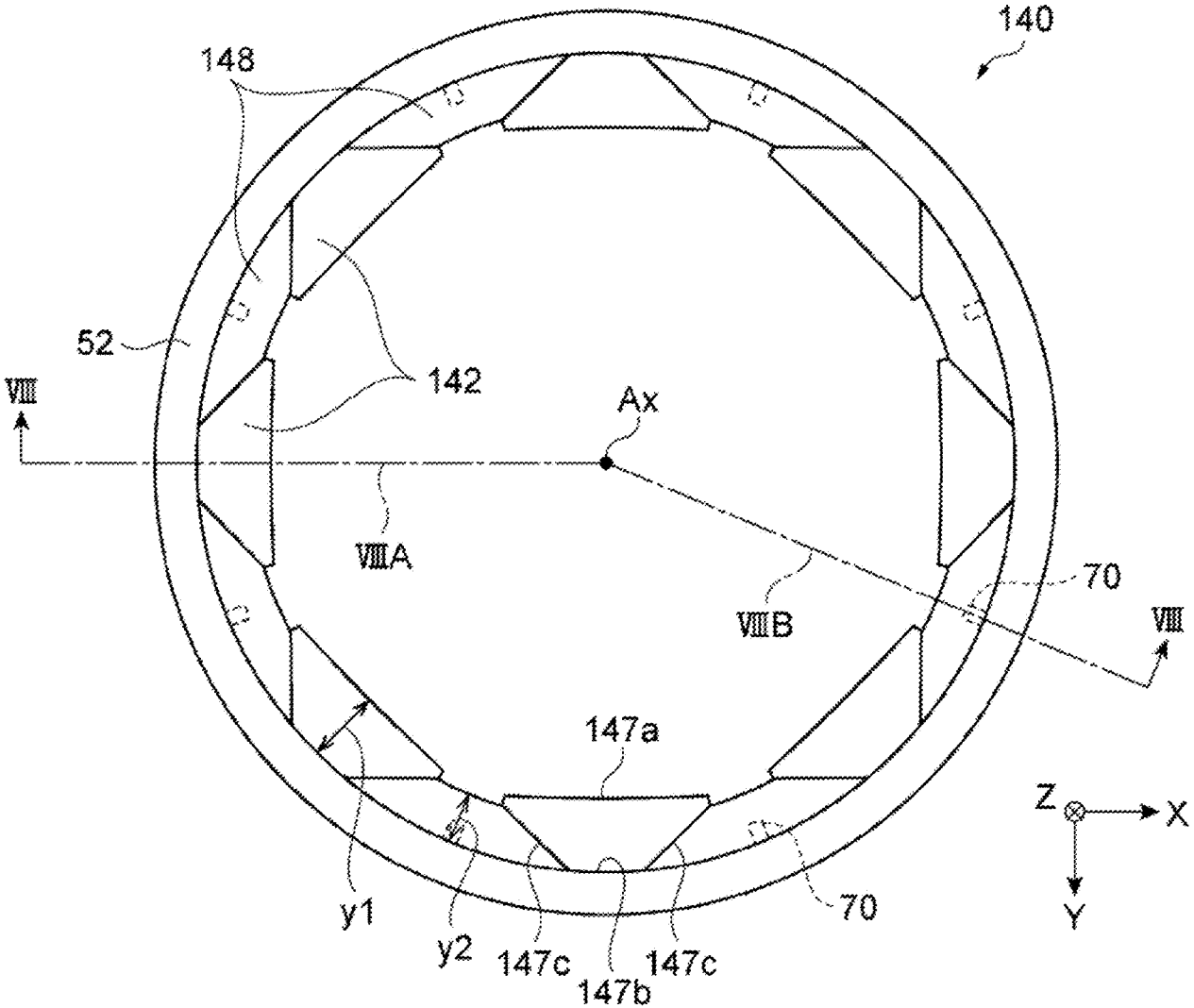
FIG. 9 is a bottom view showing an example of a band portion.

FIG. 9 shows a bottom view of the band portion 140 as viewed from below along the center axis Ax, and does not show some of the elements of the cap 10 or the spout 40. The left half of FIG. 8 shows a cross section taken along line VIIIA in FIG. 9, and the right half of FIG. 8 shows a cross section taken along line VIIIB in FIG. 9. The band portion 140 has the main body 52, a plurality of hook portions 142, and a plurality of thin portions 148.

The hook portions 142 have the same function as the hook portions 54. The hook portions 142 are connected to the lower end portion of the main body 52, and extend from the lower end portion toward the top plate 12 of the cap 10. The hook portions 142 are inclined with respect to the center axis Ax and a plane perpendicular to the center axis Ax (X-Y plane in FIGS. 8 and 9). The hook portions 142 are provided so that the distance between the center axis Ax and the hook portions 142 decreases toward the top plate 12.

The plurality of hook portions 142 have a function of restricting relative movement of the cap 10 away from the spout 40. At least part of a tip 142*a* (upper end surface) of the hook portions 142 faces a lower surface 138*a* of the protrusion 138 of the spout 40. During removal of the cap 10, the hook portions 142 abut the lower surface 138*a* of the protrusion 138, thus restricting relative movement of the cap 10 away from the spout 40.

The hook portions 142 may be provided apart from the spout 40 to face the lower surface 138*a* of the protrusion 138. The hook portions 142 may be provided so that no portion of the hook portions 142 is in contact with the side wall 42 or the protrusion 138. The tip 142*a* (upper end surface) of the hook portions 142 may be apart from the spout 40. The tip 142*a* of the hook portions 142 is not in contact with the side wall 42 or the protrusion 138 of the spout 40 while the tip 142*a* of the hook portions 142 is apart from the spout 40. The tip 142*a* of the hook portions may not be in contact with the inner peripheral surface of the main body 52 either (may also be apart from the inner peripheral surface of the main body 52) while the tip 142*a* is not in contact with the spout 40.

The hook portions 142 each have a base end portion 143 that is connected to the lower end portion of the main body 52 and curved downward, and an inclination portion 144 that is connected to the base end portion 143 and extends toward the top plate 12. The base end portion is curved downward to be convex downward. The tip of the inclination portion 144 (the end surface of the inclination portion 144 that is opposite to the end surface of the inclination portion that is connected to the base end portion 143) corresponds to the tip 142*a* of the hook portions 142.

As shown in FIG. 9, the plurality of hook portions 142 are arranged in the circumferential direction around the center axis Ax. The plurality of hook portions 142 are arranged at intervals (provided at predetermined intervals) in the circumferential direction around the center axis Ax. The band portion 140 may have eight hook portions 142. Unlike in the example shown in FIG. 9, the band portion 140 may have nine to twelve hook portions 142. When the band portion 140 has eight or more hook portions 142, the hook portions 142 are more likely to be caught by the protrusion 138, thus generating the force required to break the breaking portion 60 during removal of the cap 10. When the band portion 140 has twelve or less hook portions 142, bending processing of the hook portions 142 is easily performed. The hook portions 142 each have a plate shape to extend in the circumferential direction around the center axis Ax. The hook portions 142 may have the same shape.

Each of the plurality of thin portions 148 couples adjacent ones of the plurality of hook portions 142 in the circumferential direction around the center axis Ax. The hook portions and the thin portions 148 are alternately arranged in the circumferential direction around the center axis Ax. Each of the thin portions 148 couples (connects) two of the hook portions 142 between which the corresponding thin portion 148 is located in the circumferential direction around the center axis Ax. The thin portions 148 each have a plate shape to extend in the circumferential direction around the center axis Ax. The thin portions 148 may have the same shape.

Figure 11B:
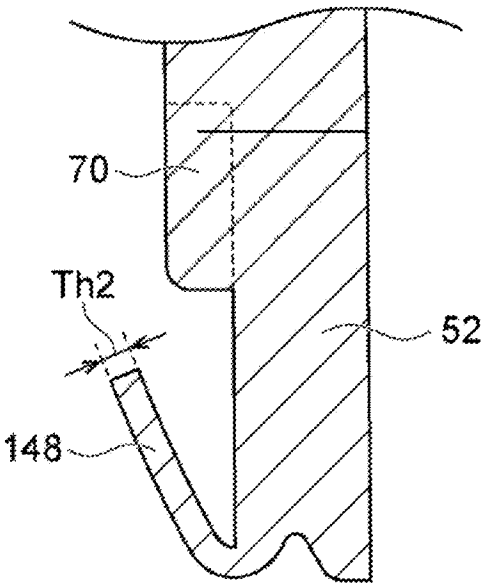
FIG. 11 (*a*) is a schematic diagram of an example of bending of a hook portion.
Figure 11A:
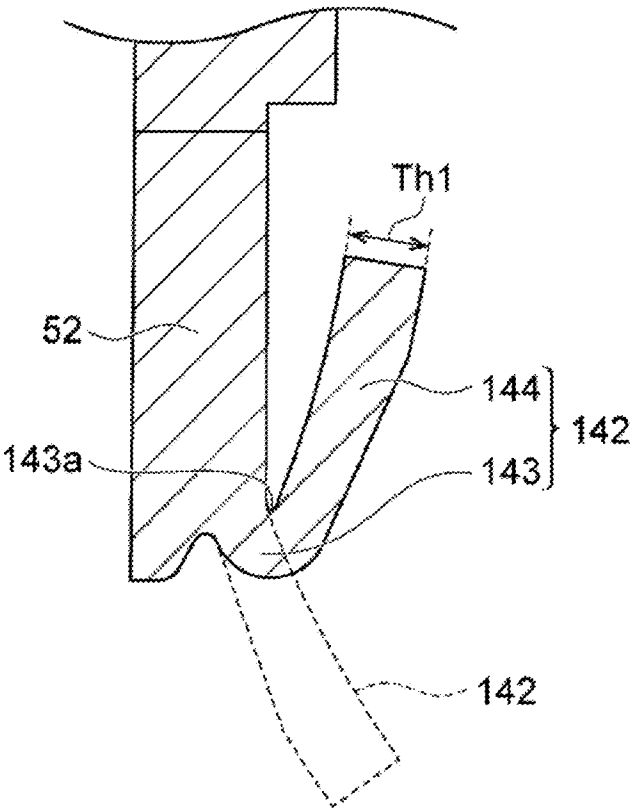

A thickness Th2 of the plurality of thin portions 148 is smaller than a thickness Th1 of the plurality of hook portions 142 (see also FIGS. 11(*a*) and 11 (*b*)). The plurality of thin portions may have substantially the same thickness Th2, and the plurality of hook portions 142 may have substantially the same thickness Th1. From the viewpoint of reducing the restoring force of the hook portions 142, the ratio of the thickness Th1 of the hook portions 142 to the thickness Th2 of the thin portions 148 may be 5.0 or less, 4.5 or less, 4.0 or less, or 3.5 or less. From the viewpoint of the ease of processing of the hook portions 142, the ratio of the thickness Th1 of the hook portions 142 to the thickness Th2 of the thin portions 148 may be 1.5 or more, 2.0 or more, 2.5 or more, or 3.0 or more. The ratio of the thickness Th1 of the hook portions 142 to the thickness Th2 of the thin portions 148 may be 1.5 to 5.0, or 2.0 to 4.5.

From the viewpoint of reducing the restoring force of the hook portions 142, the thickness Th2 of the thin portions 148 may be 0.15 mm or more, 0.18 mm or more, 0.20 mm or more, or 0.22 mm or more. From the viewpoint of the ease of processing of the hook portions 142, the thickness Th2 of the thin portions 148 may be 0.35 mm or less, 0.32 mm or less, 0.30 mm or less, or 0.28 mm or less. The thickness Th2 of the thin portions 148 may be 0.15 mm to 0.35 mm, or 0.22 mm to 0.28 mm. The thickness Th2 of the thin portions 148 may be measured at the tip of the thin portions 148 (the tip surface of the thin portions 148 that is located opposite to the main body 52).

From the viewpoint of exerting the function of the hook portions 142, the thickness Th1 of the hook portions 142 may be 0.60 mm or more, 0.62 mm or more, 0.64 mm or more, or 0.65 mm or more. From the viewpoint of the ease of processing of the hook portions 142, the thickness Th1 of the hook portions 142 may be 0.80 mm or less, 0.78 mm or less, 0.76 mm or less, or 0.75 mm or less. The thickness Th1 of the hook portions 142 may be 0.6 mm to 0.8 mm, or 0.65 mm to 0.75 mm. The thickness Th1 of the hook portions 142 may be measured at the tip of the hook portions 142 (the tip surface of the hook portions 142 that is located opposite to the main body 52).

The plurality of hook portions 142 may be configured such that the width of the hook portions 142 decreases from the tip of the hook portions 142 (the end of the hook portions that is close to the center axis Ax) toward the lower end portion of the main body 52. In such a case, it is easy to perform bending processing at the base of the hook portions 142 while the range in which the hook portions 142 abut the protrusion 138 is maintained during removal of the cap 10. As shown in FIG. 9, the width of the hook portions 142 in the circumferential direction around the center axis Ax decreases from the inside toward the outside as viewed from below along the center axis Ax. The length of a line segment connecting both ends of an inner peripheral edge 147*a* of the hook portions 142 is smaller than the length of a line segment connecting both ends of an outer peripheral edge 147*b* of the hook portions 142 as viewed from below along the center axis Ax. The length of the line segment connecting both ends of the outer peripheral edge 147*b* may be ⅕ to ⅘ times the length of the line segment connecting both ends of the inner peripheral edge 147*a*. The distance between a pair of side edges 147*c* connecting the inner peripheral edge 147*a* to the outer peripheral edge 147*b* decreases with increasing distance from the center axis Ax.

The thin portions 148 may not be connected to the tip (inner peripheral edge 147*a*) of the hook portions 142. An amount of protrusion y1 of the hook portions 142 from the inner peripheral surface of the main body 52 is larger than an amount of protrusion y2 of the thin portions from the inner peripheral surface of the main body 52 as viewed from below along the center axis Ax. The amount of protrusion y2 may be 0.7 times to 0.95 times the amount of protrusion y1.

Figure 10:
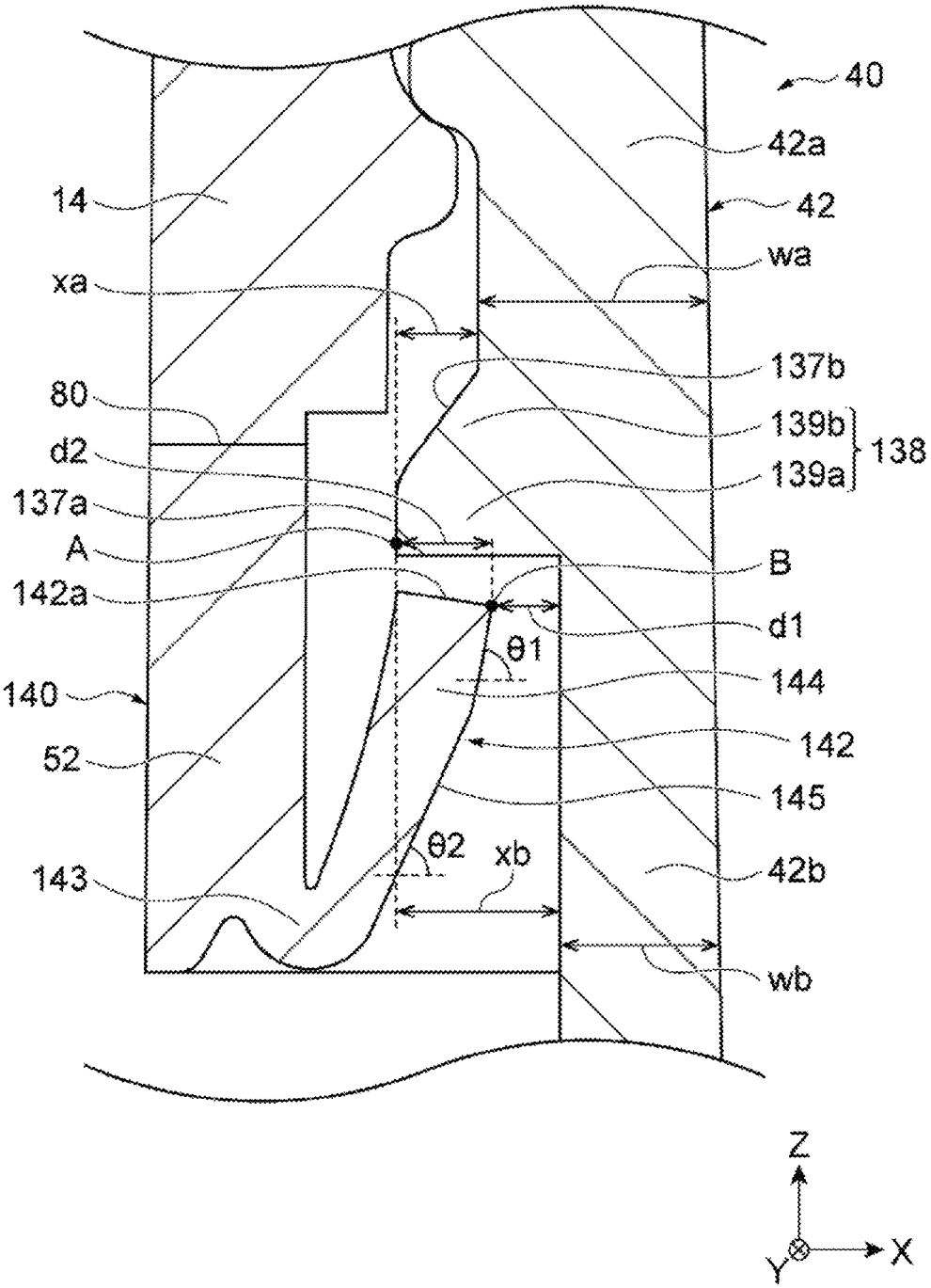
FIG. 10 is an enlarged view of a portion of the spout assembly indicated by line X in FIG. 8.

FIG. 10 shows an enlarged cross-sectional view of the region surrounded by line X in FIG. 8. FIGS. 8 and 10 show a longitudinal cross section of the spout assembly 4A taken along a plane that includes the center axis Ax and passes through one of the hook portions 142. Hereinafter, the longitudinal cross section that includes the center axis Ax and passes through one of the hook portions 142 is referred to as an "observation cross section". The observation cross section may be set to include the center axis Ax and to pass through the center of the hook portions in the circumferential direction around the center axis Ax. In the observation cross section, a direction perpendicular to the center axis Ax is defined as a "horizontal direction". In the example shown in FIG. 10, the observation cross section corresponds to the X-Z plane, and the horizontal direction corresponds to the X-axis direction.

In the observation cross section, from the viewpoint of more reliably avoiding contact between the hook portions 142 and the spout 40, a distance d1 between the hook portions and the spout 40 in the horizontal direction may be 0.30 mm or more, 0.35 mm or more, 0.40 mm or more, or 0.45 mm or more. From the viewpoint of exerting the function of the hook portions 142, the distance d1 may be 0.70 mm or less, 0.65 mm or less, 0.60 mm or less, or 0.55 mm or less. The distance d1 may be 0.3 mm to 0.7 mm, or 0.45 mm to 0.55 mm. The distance d1 is defined as the minimum distance between the hook portions 142 and the spout 40 in the horizontal direction. In the example shown in FIG. 10, the distance d1 corresponds to the minimum distance between the tip 142*a* of the hook portions 142 and the spout 40 in the horizontal direction.

In the observation cross section, from the viewpoint of exerting the function of the hook portions 142, a distance d2 in the horizontal direction between a point A that is located at the outermost position in the protrusion 138 and a point B that is located at the innermost position in the hook portions 142 may be 0.50 mm or more, 0.55 mm or more, 0.60 mm or more, or 0.65 mm or more. From the viewpoint of more reliably avoiding contact between the hook portions 142 and the spout 40, the distance d2 between the point A and the point B in the horizontal direction may be 0.9 mm or less, 0.85 mm or less, 0.80 mm or less, or 0.75 mm or less. The distance d2 may be 0.5 mm to 0.9 mm, or 0.65 mm to 0.75 mm.

In the observation cross section, from the viewpoint of more reliably avoiding contact between the hook portions 142 and the spout 40, the minimum inclination angle with respect to the horizontal direction of a side surface of the inclination portion 144 that faces the center axis Ax (a portion of a side surface 145 of the hook portions 142 that corresponds to the inclination portion 144) may be 50° or more, 55° or more, 60° or more, or 65° or more. From the viewpoint of exerting the function of the hook portions 142, the minimum inclination angle may be 85° or less. The maximum inclination angle may be 85° or less. When the side surface of the inclination portion 144 that faces the center axis Ax has a plurality of inclination angles, the plurality of inclination angles (the smallest angle of the plurality of inclination angles) may be 50° or more, or 50° to 85°. In the example shown in FIG. 10, "θ1" and "θ2" represent the plurality of inclination angles, and the inclination angle θ2 is smaller than the inclination angle θ1. The inclination angle θ2 may be 50° or more.

A portion of the side wall 42 of the spout 40 that is located above the protrusion is defined as an "upper portion 42*a*", and a portion of the side wall 42 of the spout 40 that is located below the protrusion 138 is defined as a "lower portion 42*b*". The protrusion 138 may have a protruding portion 139*a* constituting a side surface 137*a* that extends along the center axis Ax and faces the inner peripheral surface of the main body 52, and an inclined portion 139*b* constituting an inclined surface 137*b* that is inclined from the upper end of the side surface 137*a* of the protruding portion 139*a* and extends to the upper portion 42*a*. The upper portion 42*a* of the side wall 42 is located above the upper end of the inclined portion 139*b*, and the lower portion 42*b* of the side wall 42 is located below the lower end of the protruding portion 139*a*. The slit 80 is located above the upper end of the protruding portion 139*a* (side surface 137*a*) constituting the side surface 137*a* of the protrusion 138.

In the observation cross section, from the viewpoint of more reliably avoiding contact between the hook portions 142 and the spout 40, a width wb of the lower portion 42*b* in the horizontal direction may be 1.40 mm or less, 1.35 mm or less, 1.30 mm or less, or 1.25 mm or less. From the viewpoint of the strength of the spout 40, the width wb may be 1.0 mm or more, 1.05 mm or more, 1.10 mm or more, or 1.15 mm or more. The width wb may be 1.0 mm to 1.4 mm, or 1.15 mm to 1.25 mm. The width wb may be smaller than a width wa of the upper portion 42*a*. The width wb may be 0.5 times to 0.8 times the width wa.

In the observation cross section, a distance xb in the horizontal direction (the minimum distance in the horizontal direction) between the lower portion 42*b* and the point A located at the outermost position in the protrusion 138 may be larger than a distance xa in the horizontal direction (the minimum distance in the horizontal direction) between the upper portion 42*a* and the point A. In such a case, it is possible to reduce the probability of contact between the hook portions 142 and the spout 40. From the viewpoint of more reliably avoiding contact between the hook portions 142 and the spout 40, the ratio of the distance xb to the distance xa may be 1.5 or more, 1.6 or more, 1.7 or more, or 1.8 or more. From the viewpoint of the ease of production of the spout 40, the ratio of the distance xb to the distance xa may be 3.0 or less.

From the viewpoint of more reliably avoiding contact between the hook portions and the spout 40, the distance xb between the lower portion 42*b* and the point A in the horizontal direction may be 1.00 mm or more, 1.05 mm or more, 1.10 mm or more, or 1.15 mm or more. From the viewpoint of the strength of the spout 40, the distance xb may be 1.40 mm or less, 1.35 mm or less, 1.30 mm or less, or 1.25 mm or less. The distance xb may be 1.0 mm to 1.4 mm, or 1.15 mm to 1.25 mm. The distance xa between the upper portion 42*a* and the point A in the width direction may be 0.4 mm to 0.8 mm.

FIG. 11 (*a*) schematically shows an example of formation of the hook portions 142. FIG. 11 (*b*) schematically shows an example of a cross section of one of the thin portions 148. The cap 10 and the band portion 140 are integrally formed by resin molding. Immediately after molding, as indicated by the dashed line in FIG. 11 (*a*), the hook portions 142 (the plurality of hook portions 142 and the plurality of thin portions 148) protrude to the outside of an internal space constituted by the cap 10 and the band portion 140. The hook portions 142 and the thin portions protruding to the outside are bent toward the internal space using a jig or the like to form the hook portions 142 and the thin portions 148 described above. At this time, the base end portion and the inclination portion 144 are formed in the hook portions 142. Bending of the hook portions 142 leads to formation of the base end portion 143 that is curved, and this can generate a restoring force that acts to cause the hook portions 142 to be returned to the original position (a restoring force that acts to cause the hook portions 142 to be inclined toward the center axis Ax).

An upper surface 143*a* of the base end portion 143 is curved to be concave downward. From the viewpoint of reducing the restoring force of the inclination portion 144, the curvature radius of the upper surface 143*a* may be 0.75 mm or less, 0.72 mm or less, 0.70 mm or less, or 0.68 mm or less. From the viewpoint of exerting the function of the hook portions 142, the curvature radius of the upper surface 143*a* may be 0.55 mm or more, 0.57 mm or more, 0.60 mm or more, or 0.62 mm or more. The curvature radius of the upper surface 143*a* may be 0.55 mm to 0.75 mm.

The spout assembly 4A is produced in the same manner as the spout assembly 4. In the cap member immediately after resin molding, the plurality of hook portions 142 and the plurality of thin portions 148 protrude to the outside of the internal space of the cap member. After resin molding, the plurality of hook portions 142 and the plurality of thin portions 148 coupled to each other are bent (folded) into the internal space of the cap member using a jig or the like. When the hook portions 142 and the thin portions 148 are bent using a jig or the like, the base end portion and the inclination portion 144 are formed in the hook portions 142. The hook portions 142 are folded into the internal space of the cap member so that the tip 142*a* of the hook portions 142 is not in contact with the spout 40 or the inner peripheral surface of the main body 52.

Second Modification

Figure 12:
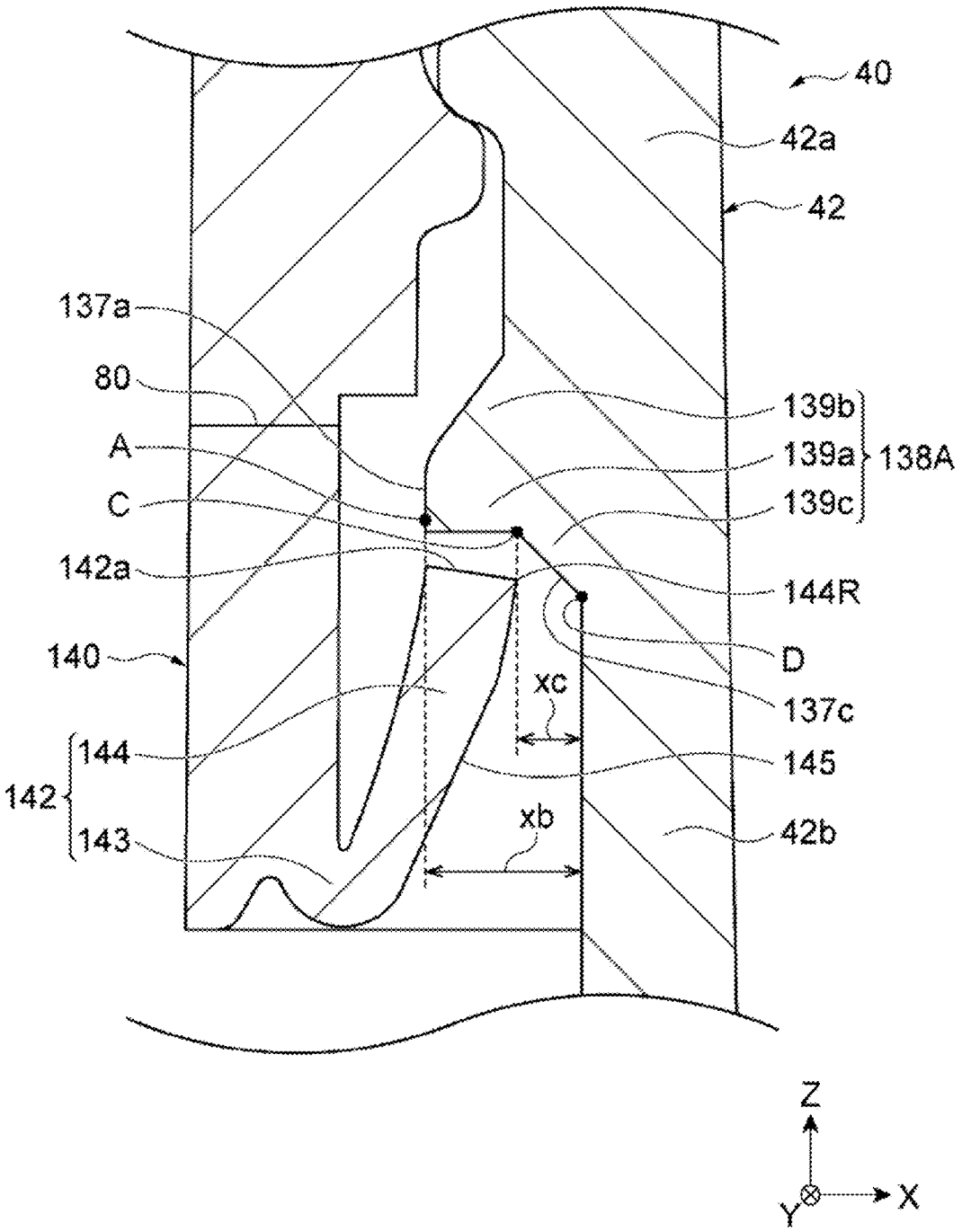
FIG. 12 is a cross-sectional view showing a spout assembly according to a second modification.

In the spout assembly 4A, as shown in FIG. 12, the spout 40 may have a protrusion 138A instead of the protrusion 138. The protrusion 138A is different from the protrusion 138 in that the protrusion 138A has an inclined portion 139*c* in addition to the protruding portion 139*a* and the inclined portion 139*b*. The inclined portion 139*c* constitutes an inclined surface 137*c* that is inclined from the lower surface of the protruding portion 139*a* and extends toward the side wall 42. The inclined surface 137*c* of the inclined portion 139*c* may extend from the lower surface of the protruding portion 139*a* to the side wall 42. In the observation cross section including the center axis Ax, a point C at which the inclined surface 137*c* of the inclined portion 139*c* intersects the lower surface of the protruding portion 139*a* is located on the inner side of the side surface 137*a* of the protruding portion 139*a* (the point A located at the outermost position in the protrusion 138A).

The protrusion 138A having the inclined surface 137*c* enables the tip 142*a* of the hook portions 142 to be brought into contact with the inclined surface 137*c* even if the hook portions 142 are inclined toward the spout 40 by the restoring force. When the tip 142*a* of the hook portions 142 is brought into contact with the inclined surface 137*c*, the hook portions 142 are smoothly moved, thus allowing the band portion 140 to smoothly fall. This makes it possible to reduce the probability that the band portion 140 remains at the original position.

The lower portion 42*b* of the side wall 42 is located below the lower end of the inclined portion 139*c*. In the observation cross section, a point D which is the boundary between the inclined portion 139*c* and the outer peripheral surface of the lower portion 42*b* (the lower end of the inclined surface 137*c*) may be located at a lower position than the tip 142*a* of the hook portions 142. In such a case, in the observation cross section, the minimum distance between the hook portions 142 (the tip 142*a* of the hook portions 142) and the spout 40 in the horizontal direction perpendicular to the center axis Ax is defined as the minimum distance between the tip 142*a* and the inclined portion 139*c* in the horizontal direction.

In the observation cross section, from the viewpoint of exerting the function of the hook portions 142, a distance xc between the outer peripheral surface of the lower portion 42*b* and the point C in the horizontal direction may be 55% or less, 50% or less, 45% or less, or 40% or less of the distance xb between the outer peripheral surface of the lower portion 42*b* and the point A in the horizontal direction. From the viewpoint of exerting the function of the hook portions 142, the distance xc may be 0.6 mm or less, 0.55 mm or less, 0.50 mm or less, or 0.45 mm or less.

In the observation cross section, a corner of the tip 142*a* of the hook portions 142 that is close to the side wall 42 may have a rounded shape. In the observed cross section, from the viewpoint of allowing the hook portions 142 to be smoothly moved when the hook portions 142 are brought into contact with the side wall 42 of the spout 40, the curvature radius of a corner 144R that is formed by the tip 142*a* and the side surface 145 of the hook portions 142 that faces the center axis Ax may be 0.30 mm or more, 0.32 mm or more, 0.34 mm or more, or 0.35 mm or more. In the observation cross section, the curvature radius of the corner 144R may be 0.6 mm or less.

Third Modification

Figure 13:
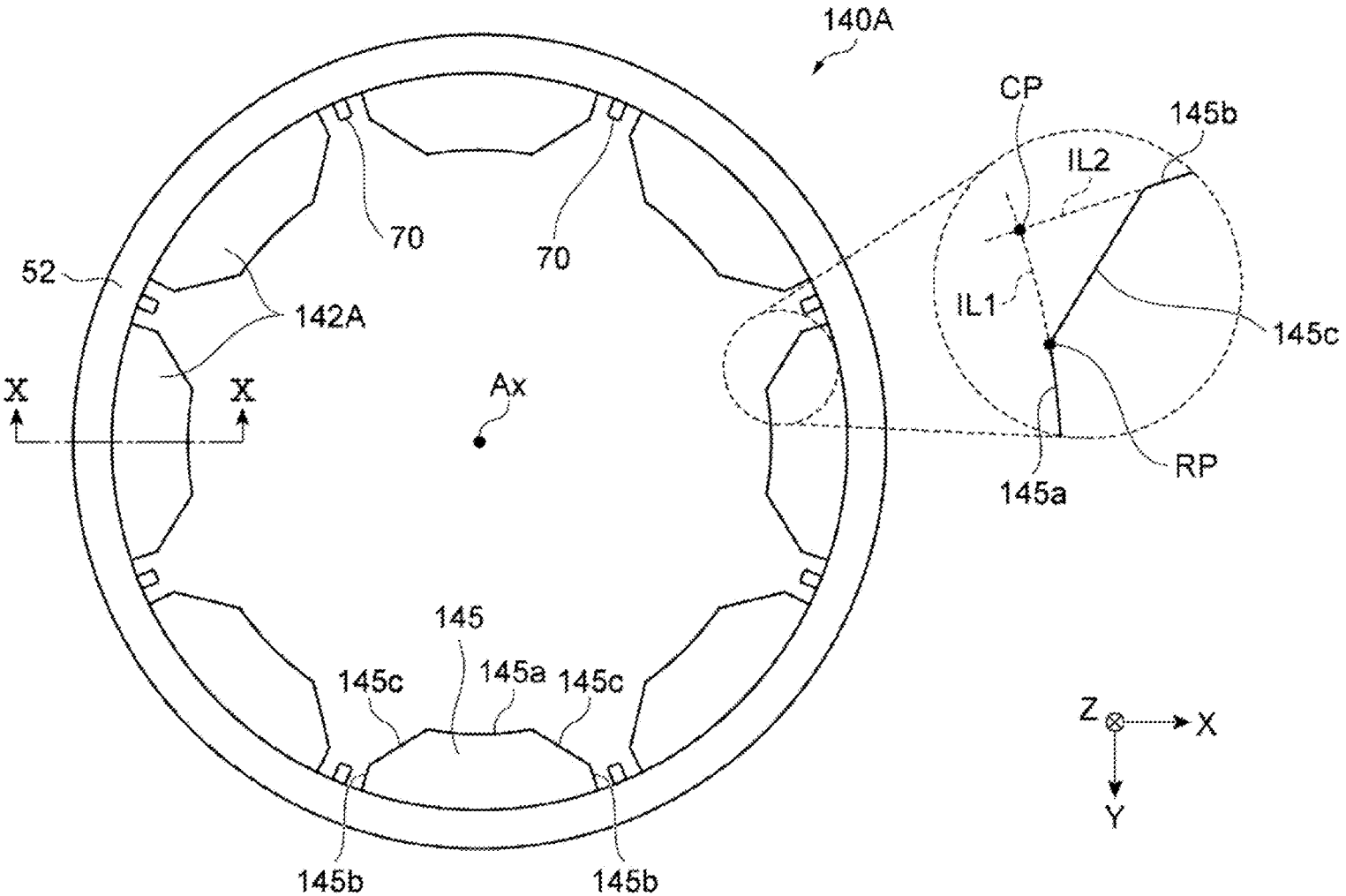
FIG. 13 is a bottom view showing a spout assembly according to a third modification.

The spout assembly 4A may have a band portion 140A instead of the band portion 140. The band portion 140A is different from the band portion 140 in that the band portion 140A has a plurality of hook portions 142A instead of the plurality of hook portions 142 and the plurality of thin portions 148. As with the hook portions 142, the hook portions 142A have a function of restricting relative movement of the cap 10 away from the spout 40. The hook portions 142A each have the base end portion 143 and the inclination portion 144. FIG. 13 shows a bottom view of the band portion 140A as viewed from below along the center axis Ax.

A cross section taken along line X-X in FIG. 13 corresponds to the cross section in FIG. 10 or 12. In a longitudinal cross section that includes the center axis Ax and passes through the center of one of the hook portions 142A in the circumferential direction (observation cross section), the shape and dimensions of the hook portions 142A may be the same as those of the hook portions 142. In the observation cross section, the relationship between the hook portions 142A and the surrounding members (the spout 40 and the main body 52) may be the same as the relationship between the hook portions 142 and the surrounding members.

As shown in FIG. 13, the plurality of hook portions 142A are arranged at predetermined intervals in the circumferential direction around the center axis Ax. The band portion 140A may have eight hook portions 142A. Unlike in the example shown in FIG. 13, the band portion 140A may have nine to twelve hook portions 142A. The hook portions 142A each have a plate shape to extend in the circumferential direction around the center axis Ax. As viewed from the direction parallel to the center axis Ax, on the inner peripheral surface of the main body 52, a region (region on the circumference) in which the hook portions 142A are provided may be larger than a region (region on the circumference) in which none of the hook portions 142A is provided. As viewed from the direction parallel to the center axis Ax, on the inner peripheral surface of the main body 52, the region in which the hook portions 142A are provided may be 3 times to 6 times the region in which none of the hook portions 142A is provided.

The side surface 145 of the hook portions 142A that faces the center axis Ax (see also FIG. 10) has a tip edge 145*a*, a pair of side edges 145*b*, and a pair of connecting edges 145*c*. The tip edge 145*a* is curved to extend along the circumference of a circle around the center axis Ax. The tip edge 145*a* is located on the inner side of the inner peripheral edge of the main body as viewed from the direction parallel to the center axis Ax (from below). The pair of side edges 145*b* extend to intersect the main body 52, and are connected to the inner peripheral edge of the main body 52 as viewed from the direction parallel to the center axis Ax (from below).

Each of the pair of connecting edges 145*c* connects an end of the tip edge 145*a* to an end of one of the side edges 145*b*. Each of the connecting edges 145*c* extends to intersect both the tip edge 145*a* and one of the side edges 145*b*. The connecting edges 145*c* may be linear, or may be curved (may have a curved shape). As shown in the enlarged view in FIG. 13, each of the connecting edges 145*c* is located between an intersection point CP and the main body 52. The intersection point CP is an intersection point of an imaginary line IL1 that extends along the tip edge 145*a* on the circumference of a circle around the center axis Ax and an imaginary line IL2 that extends along one of the side edges 145*b*. The pair of connecting edges 145*c* are located in a region defined by the inner peripheral surface of the main body 52, the imaginary line ILL and the imaginary line IL2 as viewed from the direction parallel to the center axis Ax (from below). Thus, a cutout portion is provided at each of the pair of corner portions of the side surface 145 that are closer to the center axis Ax.

From the viewpoint of allowing the hook portions 142A to be smoothly moved when the hook portions 142A are brought into contact with the side wall 42 of the spout 40, the curvature radius of a corner RP that is formed by the tip edge 145*a* and each of the connecting edges 145*c* may be 0.30 mm or more, 0.32 mm or more, 0.34 mm or more, or 0.35 mm or more. From the viewpoint of the ease of production of the band portion 140A, the curvature radius of the corner RP may be 0.55 mm or less, 0.50 mm or less, 0.47 mm or less, or 0.45 mm or less. The curvature radius of the corner RP may be 0.30 mm to 0.55 mm, or 0.35 mm to 0.45 mm.

Other Modifications

The shape of the packaging container 1 (container body 2) is not limited to the shape as shown in FIG. 1, and may be a cylindrical shape. The portion of the container body 2 to which the spout assembly 4 is attached is not limited to the portion shown in FIG. 1, and may be any portion of the container body 2.

In the above example, the knurled portion 20 is composed of the six projecting portions 22 and the six base portions 24; however, the knurled portion 20 only needs to have two or more projecting portions 22 and two or more base portions 24. For example, the knurled portion may be composed of twelve projecting portions 22 and twelve base portions 24. Instead of the base portions 24, the knurled portion 20 may have a convex projection having a top lower in height than the top 22*a* of the projecting portions 22. The knurled portion 20 may have any configuration as long as the knurled portion 20 has a plurality of projecting portions projecting outward and a portion located on the inner side of the projecting portions.

Two or more examples of the embodiments and modifications may be applied to each other. For example, the protrusion 138A according to the second modification may be applied to the spout assembly 4A according to the third modification. A matter of an example of the embodiments and modifications may be applied to any other example.

Effects of Embodiments

The spout assembly 4, 4A according to the embodiments described above includes the spout 40, the cap 10, the band portion 50, 140, 140A, and the ribs 70. The spout 40 has the side wall 42 that has a cylindrical shape, the external thread 43 that is provided on the outer peripheral surface of the side wall 42, and the flange 44 that is provided at an end of the side wall 42. The cap 10 has the top plate 12, the peripheral wall 14 that is connected to the outer peripheral edge of the top plate 12, and the internal thread 15 that is provided on the inner peripheral surface of the peripheral wall 14 and screwed to the external thread 43. The band portion 50, 140, 140A is connected to an end of the peripheral wall 14 to fix the cap 10 to the spout 40 at a position between the peripheral wall 14 and the spout 40. The ribs 70 connect the peripheral wall 14 to the band portion 50, 140, 140A, and protrude toward the inside of the cap 10 from the inner peripheral surface at the end portion of the peripheral wall 14 and the inner peripheral surface of the band portion 50, 140, 140A. The spout 40 further has the protrusion 48, 138, 138A that is provided on the side wall 42 to restrict movement of the cap 10 and the band portion 50, 140, 140A with respect to the spout 40. The band portion 50, 140, 140A and the peripheral wall 14 are defined by the slit located above the portion of the protrusion 48, 138, 138A that faces the peripheral wall 14, and the slit 80 extends to the inside of the ribs.

For example, if a slit is formed below the facing surface 48*a* of the protrusion 48 (the side surface 137*a* of the protrusion 138, 138A), when the blade of a cutter or the like is placed on the peripheral wall and the band portion to form the slit, the peripheral wall and the band portion are bent inward. In this case, the slit may not be stably formed (e.g., slits of spout assemblies may vary in size or the like), thus influencing the manufacturing quality of the band portion. On the other hand, in the spout assembly 4, 4A, the slit 80 provided in the boundary between the band portion 50, 140, 140A and the peripheral wall 14 and in the ribs 70 is located above the portion (the facing surface 48*a* or the side surface 137*a*) of the protrusion 48, 138, 138A that faces the peripheral wall 14. Accordingly, during formation of the slit 80 using the blade of a cutter or the like (e.g., a score cutter), the ribs 70 abut the protrusion 48, 138, 138A, thus preventing the peripheral wall 14 and the band portion 50, 140, 140A from being bent inward. This makes it possible to stably form the slit 80. Therefore, the spout assembly 4, 4A is useful to allow the band portion 50, 140, 140A to have stable quality.

The ribs 70 may have a thickness of 0.4 mm to 0.6 mm. If the ribs 70 have a small thickness, the spout 40 may be damaged during formation of the slit 80. In the present configuration, the ribs 70 having the above thickness facilitate formation of a slit in a portion of the ribs 70 to obtain the thin portions 82.

The band portion 50, 140, 140A may be connected to the end of the peripheral wall of the cap 10 so that the band portion 50, 140, 140A and the cap 10 are separated from each other when the cap 10 is removed from the spout 40. The gap g may be provided between the lower end of the band portion 50, 140, 140A and the portion of the flange 44 that faces the lower end of the band portion 50, 140, 140A. The gap g may have a width of 0.5 mm or more. In such a case, the gap g1 is formed between the band portion 50, 140, 140A and the cap 10 when the band portion 50, 140, 140A is once separated from the cap 10 and then the cap 10 is reattached to the spout 40. The gap g1 may also have a width of approximately 0.5 mm or more. This is useful to allow the gap g1 to have high visibility after the cap is opened. Furthermore, in the spout assembly having the gap g, the peripheral wall and the band portion may be bent more during formation of the slit than in the spout assembly having no gap g. However, in the present configuration, the ribs 70 abut the protrusion 48 (facing surface 48*a*) or the protrusion 138, 138A (side surface 137*a*), thus facilitating formation of the slit.

The distance between the lower end of the band portion 50, 140, 140A and the slit may be 6.0 mm or less. In such a case, it is easy to secure the size of the cap 10 or the gap g. For example, it is possible to secure a sufficient region for the knurled portion 20 provided to improve the operability during opening of the cap.

The band portion 50, 140, 140A may have the main body 52 that has a cylindrical shape and in which the ribs 70 are provided, and the hook portions 54, 142, 142A that are inclined from the lower end portion of the main body 52 toward the top plate 12. The hook portions 54, 142, 142A may be configured to abut the protrusion 48, 138, 138A to restrict movement of the cap away from the spout 40. In such a case, it is possible to prevent unintended opening of the cap 10.

The hook portions 142, 142A may be provided apart from the spout 40 to face the lower surface 138*a* of the protrusion 138, 138A. Bending processing of the hook portions 142, 142A may generate a restoring force that acts to cause the hook portions 142, 142A to be inclined toward the spout 40. If the spout 40 is held by the hook portions 142, 142A in contact with the spout 40 due to the restoring force, the band portion 140, 140A may remain at the original position instead of falling downward when the cap 10 is removed. In the spout assembly 4A, the hook portions 142, 142A are provided apart from the spout 40 to face the lower surface of the protrusion 138, 138A; thus, the hook portions are less likely to be brought into contact with the spout when the cap is removed. Thus, in the spout assembly 4A, the band portion 140, 140A detached from the cap can smoothly fall. Therefore, the spout assembly 4A is useful to allow the band portion 140, 140A to have a stable quality.

The plurality of hook portions 142 may be arranged at intervals in the circumferential direction around the center axis Ax of the cap 10. The band portion 140 may have the plurality of thin portions 148 each of which connects adjacent ones of the plurality of hook portions 142 and that have a smaller thickness than the plurality of hook portions 142. Even if a restoring force acts to cause one of the hook portions 142 to be inclined toward the center axis Ax, the plurality of thin portions 148 coupling the hook portions restrict inclination movement. This makes it possible to reduce the probability that the hook portions 142 are inclined toward the center axis Ax and brought into contact with the spout 40. Therefore, the spout assembly is useful to allow the band portion 140 to have a stable quality.

REFERENCE SIGNS LIST

1 . . . Packaging container; 2 . . . Container body; 4, 4A . . . Spout assembly; 10 . . . Cap; 12 . . . Top plate; 14 . . . Peripheral wall; 15 . . . Internal thread; 40 . . . Spout; 42 . . . Side wall; 43 . . . External thread; 44 . . . Flange; 48, 138, 138A . . . Protrusion; 50, 140,

140A . . . Band portion; 52 . . . Main body; 54, 142, 142A . . . Hook portion; 148 . . . Thin portion; 70 . . . Rib; 80 . . . Slit; g, g1 . . . Gap.

What is claimed is:

1. A spout assembly, comprising:

a spout having a side wall that has a cylindrical shape, an external thread that is provided on an outer peripheral surface of the side wall, and a flange that is provided at an end of the side wall;

a cap having a top plate, a peripheral wall that is connected to an outer peripheral edge of the top plate, and an internal thread that is provided on an inner peripheral surface of the peripheral wall and screwed to the external thread;

a band portion that is connected to an end of the peripheral wall to fix the cap to the spout at a position between the peripheral wall and the spout; and a rib that connects the peripheral wall to the band portion and protrudes toward an inside of the cap from the inner peripheral surface at an end portion of the peripheral wall and an inner peripheral surface of the band portion, wherein the spout further has a protrusion that is provided on the side wall to restrict movement of the cap and the band portion with respect to the spout, the band portion and the peripheral wall are defined by a slit located above a portion of the protrusion that faces the peripheral wall, and the slit extends to an inside of the rib, wherein the rib has a thickness of 0.4 mm to 0.6 mm;

wherein the band portion is connected to the end of the peripheral wall of the cap so that the band portion and the cap are separated from each other when the cap is removed from the spout, a gap is provided between a lower end of the band portion and a portion of the flange that faces the lower end of the band portion, and the gap has a width of 0.5 mm or more; and wherein a distance between a lower end of the band portion and the slit is 6.0 mm or less.

2. The spout assembly of claim 1, wherein the band portion has a main body that has a cylindrical shape and in which the rib is provided, and a hook portion that is inclined from a lower end portion of the main body toward the top plate, and the hook portion is configured to abut the protrusion to restrict movement of the cap away from the spout.

3. The spout assembly of claim 2, wherein the hook portion is provided apart from the spout to face a lower surface of the protrusion.

4. The spout assembly of claim 2, wherein the band portion has a plurality of hook portions including the hook portion, the plurality of hook portions are arranged at intervals in a circumferential direction around a center axis of the cap, and the band portion further has a plurality of thin portions each of which connects adjacent ones of the plurality of hook portions and that have a smaller thickness than the plurality of hook portions.

5. A packaging container, comprising:

the spout assembly of claim 1; and a container body to which the spout assembly is attached.

6. A method of producing the spout assembly of claim 1, the method comprising the steps of:

preparing a spout having a side wall that has a cylindrical shape and has an outer peripheral surface on which an external thread is provided, a flange that is provided at an end of the side wall, and a protrusion that protrudes outward from the side wall;

preparing a cap member having a top plate, a peripheral wall that is connected to an outer peripheral edge of the top plate and has an inner peripheral surface on which an internal thread is provided, and a rib that protrudes from an inner peripheral surface of the peripheral wall;

screwing the internal thread to the external thread to attach the cap member to the spout; and forming a slit at a position above a portion of the protrusion that faces the peripheral wall while the cap member is attached to the spout, the slit extending from an outer edge of the peripheral wall to an inside of the rib.

7. A spout assembly, comprising:

a spout having a side wall that has a cylindrical shape, an external thread that is provided on an outer peripheral surface of the side wall, and a flange that is provided at an end of the side wall;

a cap having a top plate, a peripheral wall that is connected to an outer peripheral edge of the top plate, and an internal thread that is provided on an inner peripheral surface of the peripheral wall and screwed to the external thread;

a band portion that is connected to an end of the peripheral wall to fix the cap to the spout at a position between the peripheral wall and the spout; and a rib that connects the peripheral wall to the band portion and protrudes toward an inside of the cap from the inner peripheral surface at an end portion of the peripheral wall and an inner peripheral surface of the band portion, wherein the spout further has a protrusion that is provided on the side wall to restrict movement of the cap and the band portion with respect to the spout, the band portion and the peripheral wall are defined by a slit located above a portion of the protrusion that faces the peripheral wall, and the slit extends to an inside of the rib, wherein the band portion has a main body that has a cylindrical shape and in which the rib is provided, and a hook portion that is inclined from a lower end portion of the main body toward the top plate, and the hook portion is configured to abut the protrusion to restrict movement of the cap away from the spout, and wherein the band portion has a plurality of hook portions including the hook portion, the plurality of hook portions are arranged at intervals in a circumferential direction around a center axis of the cap, and the band portion further has a plurality of thin portions each of which connects adjacent ones of the plurality of hook portions and that have a smaller thickness than the plurality of hook portions.

8. The spout assembly of claim 7, wherein the rib has a thickness of 0.4 mm to 0.6 mm.

9. The spout assembly of claim 7, wherein the band portion is connected to the end of the peripheral wall of the cap so that the band portion and the cap are separated from each other when the cap is removed from the spout, a gap is provided between a lower end of the band portion and a portion of the flange that faces the lower end of the band portion, and the gap has a width of 0.5 mm or more.

10. The spout assembly of claim 7, wherein a distance between a lower end of the band portion and the slit is 6.0 mm or less.

11. A packaging container, comprising:

the spout assembly of claim 1; and a container body to which the spout assembly is attached.

* * * * *